US005305890A

United States Patent [19]

Ishikawa

[11] Patent Number: 5,305,890

[45] Date of Patent: Apr. 26, 1994

[54] CIRCULATORY STORAGE APPARATUS

[75] Inventor: Koichi Ishikawa, Shizuoka, Japan

[73] Assignee: Marushin Company Limited, Tokyo, Japan

[21] Appl. No.: 931,922

[22] Filed: Aug. 18, 1992

[30] Foreign Application Priority Data

| | | | |
|---|---|---|---|
| Aug. 22, 1991 | [JP] | Japan | 3-092330[U] |
| Aug. 22, 1991 | [JP] | Japan | 3-092331[U] |
| Dec. 13, 1991 | [JP] | Japan | 3-114089[U] |
| Dec. 25, 1991 | [JP] | Japan | 3-114451 |

[51] Int. Cl.[5] ..... A47F 5/02

[52] U.S. Cl. ..... 211/122; 211/162; 312/267

[58] Field of Search ..... 211/162, 182, 189, 122; 312/267, 268, 319.7; 16/106

[56] References Cited

U.S. PATENT DOCUMENTS

| | | | |
|---|---|---|---|
| 2,807,058 | 9/1957 | Morgan | 16/106 |
| 3,368,688 | 2/1968 | Weiss et al. . | |
| 3,780,852 | 12/1973 | Weiss et al. | 211/122 |
| 3,958,691 | 5/1976 | Schaeffer | 211/162 |
| 3,973,504 | 8/1976 | Knudsen | 211/162 |
| 4,423,685 | 1/1984 | Kerckhoff | 16/106 |
| 4,752,987 | 6/1988 | Dreyer et al. | 16/106 |
| 5,062,536 | 11/1991 | Tsai | 211/122 |

FOREIGN PATENT DOCUMENTS 62-266007 11/1987 Japan .

OTHER PUBLICATIONS

"The Closet Carosel," *White Home Products, Inc. Catalog*, Copyright 1990 White Home Products, Inc.

"The Automated Closet Carosel," *White Carosels, Inc. Catalog*, Copyright 1983 White Machine, Inc.

*Primary Examiner*—Paula A. Bradley

*Assistant Examiner*—Chuck Y. Mah

*Attorney, Agent, or Firm*—Sughrue, Mion, Zinn, Macpeak & Seas

[57] ABSTRACT

An upper endless rail has a downwardly opened guide channel, and a lower endless rail has an upwardly opened guide channel. A plurality of circulatory frames are mounted for movement along and between the upper and lower endless rails. Each circulatory frame has a plurality of casters mounted at a lower side portion thereof and positioned in the guide channel of the lower endless rail and further has a plurality of upper guide rollers mounted at an upper side portion thereof for contacting with and rolling on a side face or faces of and in the guide channel of the upper endless rail. Each caster includes a support roller for rolling on an inner bottom face of the guide channel of the lower endless rail and a lower guide roller for contacting with and rolling on an inner side face or faces of the guide channel. Each circulatory frame is moved with the load thereof supported by the support rollers of the casters from below while rocking motion of a lower portion of the circulatory frame is prevented by the lower guide rollers. The weight of the circulatory frames does not act upon the upper endless rail at all.

12 Claims, 29 Drawing Sheets

CIRCULATORY STORAGE APPARATUS

BACKGROUND OF THE INVENTION

1. Field of the Invention

This invention relates to a circulatory storage apparatus for home use for storing a large number of clothes, books, daily necessaries and like articles efficiently therein and transporting a desired one of the stored articles quickly to a desired position of the apparatus, and more particularly to a circulatory storage apparatus wherein a plurality of rectangular circulatory frames on which hanger bars, cages or like members are mounted are interconnected by means of links and mounted for circulatory movement between and along upper and lower endless rails such that, when the circulatory frames are moved successively along the upper and lower endless rails, clothes hung on the hanger bars, books carried on the racks, daily necessaries accommodated in the cages or the like are circulatorily transported.

2. Description of the Related Art

A circulatory storage apparatus for documents is already known and disclosed in U.S. Pat. No. 3,368,688. Home products which were a modification to the circulatory storage apparatus for clothes for home use were put on the market for several years from 1983 under the name of "Closet Carousel" from WHITE CAROUSEL, INC. in the United State. After then, similar products of a little modified form have been put on the market and are still put on the market from WHITE HOME PRODUCTS, INC. in the United States. Further, a circulatory storage apparatus for the same use which is further modified from the two products is disclosed in Japanese Patent Laid-Open Application No. 62-266007.

The conventional apparatus have a common structure in that a rectangular circulatory frame is hung on an upper endless rail by means of a pair of trolleys securely mounted at an upper side of the circulatory frame while a pair of lower rollers securely mounted on a lower side of the circulatory frame are engaged with a lower endless rail to prevent rocking motion of the rectangular circulatory frame. In short, the conventional apparatus is common in the basic structure in that the circulatory frame is hung for travelling movement on the upper endless rail while rocking motion of the circulatory frame is prevented by the lower endless rail.

Further, the trolleys are mounted on the upper side of the circulatory frame with mounting shafts therefor fitted for rotation through holes formed at predetermined locations of the upper side of the circulatory frame, and the lower rollers are either mounted directly on the circulatory frame with shafts therefor fitted in holes formed at predetermined locations of the lower side of the circulatory frame or supported for pivotal motion on a bracket which is securely mounted on the circulatory frame making use of such holes. A hanger bar is mounted on and extends horizontally between the opposite right and left sides of the circulatory frame with the opposite ends thereof secured to the left and right sides of the circulatory frame by means of screws fitted in holes formed in the left and right sides of the circulatory frame. The circulatory frame is formed either by joining the upper and lower side members and the left and right side members to each other by means of screws or by forming the four side members as a unitary member.

With the conventional apparatus of the structure described above, however, since a total weight of the circulatory frames and articles supported on the circulatory frames is applied as it is as a suspended load to the upper endless rail, the upper endless rail, support columns for the upper endless rail, the trolleys and so forth must have a strength and a structure sufficient to bear the suspended load, and besides, as the suspended load increases, the center of gravity of the entire apparatus rises, which deteriorates the stability of the apparatus. Therefore, many reinforcing members are required, which makes the cost of the apparatus high. Further, since the circulatory frames have a suspended structure, the operability of them is not high, and in order to move the circulatory frames, a great force is required particularly at a corner at which the endless rails are curved. Thus, in the products for home use such as the products of WHITE CAROUSEL, INC. and the products of WHITE HOME PRODUCTS, INC., the circulatory frames are driven to move by means of a motor, also which makes a cause of a high cost.

Further, in order to mount trolleys, hanger bars and lower rollers onto a circulatory frame, the circulatory frame must have mounting holes formed therein, which is one of the causes of a great number of man-hours required for manufacture of the apparatus, and besides, since the parts must be fitted into and through the holes, much time is required for mounting of them. Further, since the mounting positions of the trolleys, hanger bars and lower rollers depend naturally upon the positions of the holes, the their positions cannot be adjusted freely.

SUMMARY OF THE INVENTION

It is an object of the present invention to provide a circulatory storage apparatus of a reduced cost wherein the entire apparatus is highly stable and circulatory frames can be moved easily with the center of gravity thereof kept low.

It is another object of the present invention to provide a circulatory storage apparatus wherein manufacture and assembly of circulatory frames and mounting of the circulatory frames onto upper and lower endless frames can be performed readily.

It is a further object of the present invention to provide a circulatory storage apparatus wherein mounting positions of rollers for moving circulatory frames along upper and lower endless rails and hanger bars mounted on the circulatory frames can be adjusted freely.

In order to attain the objects, according to the present invention, a circulatory storage apparatus employs a supporting structure for a circulatory frame on a pair of upper and lower endless rails which is the reverse of the supporting structure of the conventional circulatory storage apparatus. In short, a supporting structure wherein the circulatory frame is supported for movement on the lower endless rail while rocking motion of the circulatory frame is prevented by the upper endless rail.

In particular, according to the present invention, there is provided a circulatory storage apparatus which comprises a pair of upper and lower endless rails, the upper endless rail having a downwardly opened guide channel formed along the overall length therein while the lower endless rail has an upwardly opened guide channel formed along the overall length therein, a plurality of rectangular circulatory frames mounted for circulatory movement along the upper and lower endless rails and each having a pair of parallel upper and lower side portions and a pair of parallel left and right side portions, a plurality of casters mounted on the lower side portion of each of the circulatory frames and positioned in the guide channel of the lower endless rail, each of the casters including a support roller for rolling on an inner bottom face of the guide channel of the lower endless rail and a lower guide roller or rollers for contacting with and rolling on an inner side face or faces of the guide channel of the lower endless rail, a plurality of upper guide rollers mounted on the upper side portion of each of the circulatory frames for contacting with and rolling on an inner side face or faces of the guide channel of the upper endless rail, and a pair of upper and lower series of links for interconnecting the circulatory frames.

With the circulatory storage apparatus, each circulatory frame is supported for movement on the lower endless rail by way of the plurality of casters while rocking motion thereof is prevented by the upper endless rail by way of the upper guide rollers and the weight thereof does not act upon the upper endless rail at all. Thus, since the load bearing point for each circulatory frame always remains on the lower endless rail, the center of gravity of the entire apparatus is at a low position and consequently the stability of the apparatus is high. Further, since the upper endless rail and support posts therefor need not have such a high strength sufficient to bear the total weight of the circulatory frames and articles supported on the circulatory frames.

The casters provide a high travelling performance to the circulatory frame since the support rollers thereof roll on the inner bottom face of and in the guide channel of the lower endless rail while the lower guide rollers thereof roll on the inner side face or faces of the guide channel of the lower endless rail. Further, since each circulatory frame is moved with the load thereof supported by the casters while the lower guide rollers assure travelling movement of the circulatory frame with a low frictional force along the lower endless rail and prevent rocking motion of a lower portion of the circulatory frame and besides the upper guide rollers prevent rocking motion of an upper portion of the circulatory frame and assure travelling movement of the circulatory frame with a low frictional force, the circulatory frame can be moved smoothly also at a corner portion at which the endless rails are curved.

Preferably, each of the casters includes a caster frame which has a pivot provided at the center of an upper face thereof and has a pair of wing portions on the opposite sides thereof, and an axle for the support roller is supported horizontally on the caster frame while a shaft is provided at each of the wing portions and has one of the lower guide rollers supported for rotation thereon. In this instance, each of the casters may be formed as a unitary molded member of a plastic material and including the caster frame, the pivot, the wing portions and the shafts. In order to allow easy mounting of the casters and the upper guide rollers at arbitrary positions of the circulatory frames, each of the circulatory frames may be constructed such that the upper side portion thereof has a C-shaped cross section defining a groove with an upwardly opened slit while the lower side portion thereof has a C-shaped cross section defining a groove with a downwardly opened slit and a plurality of bearing blocks each having a bearing hole and a mounting hole formed therein are secured to the upper and lower side portions such that a screw fitted in the mounting hole of each of the bearing blocks is screwed through the slit of the upper or lower side portion of the circulatory frame into a nut which is inserted in the groove of the upper or lower side portion. Each of the casters is mounted for turning motion around a vertical axis on the lower side of the lower side portion of the circulatory frame with the pivot thereof fitted in the bearing hole of one of the bearing blocks secured to the lower side portion of the circulatory frame, and each of the upper guide rollers is mounted for rotation on the upper side of the upper side portion of the circulatory frame with the shaft thereof fitted in the bearing hole of one of the bearing blocks secured to the upper side portion of the circulatory frame.

Preferably, the circulatory storage apparatus further comprises a hard wire having a circular shape at least an upper face thereof and provided on the inner bottom face of the guide channel of the lower endless rail over the overall length in such a manner as to extend upwardly from the inner bottom face. Thus, since the support rollers of the casters roll in a point contacting condition on the circular upper face of the hard wire, even if the load of the circulatory frame is increased, the circulatory frame can still be moved light.

Preferably, each of the links includes a plurality of members connected for pivotal motion to each other, and the circulatory storage apparatus further comprises a roller supported for rotation at each of connecting portions of the members of each of the links to interconnect the two adjacent members of the link and positioned to contact with and roll on the inner side face or faces of the guide channel of the upper or lower endless rail. Thus, diverting movement of each of the circulatory frames can be performed smoothly at a corner portion at which the upper and lower endless rails are curved.

In order to allow easy mounting of a hanger bar at an arbitrary vertical position of each circulatory frame, preferably each of the circulatory frames is constructed such that the left and right side portions thereof individually have C-shaped cross sections individually defining grooves with inwardly opened slits and a hanger bar is mounted between the left and right side portions of the circulatory frame with the opposite ends thereof fitted in a pair of left and right sockets which are secured to the left and right side portions, respectively, by means of screws threaded through the sockets into nuts individually inserted in the grooves of the left and right side portions. In this instance, in order that clothes hung on such hanger bars on different ones of the circulator frames may not interfere with each other even if the upper and lower endless rails have a comparatively small overall size, preferably, the hanger bar has a plurality of fins formed at fixed intervals at a portion thereof other than an end portion of a first length and the other end portion of a second length greater than the first length in such a manner as to extend obliquely to an axial line of the hanger bar.

In order to facilitate manufacture and assembly of each circulatory frame itself, preferably the upper, lower and left, right side portions of each of the circulatory frames are individually formed from separate metal members having a same C-shaped cross section defining a groove, and the four metal members are joined together into the form of a rectangular frame by means of four elbows. In this instance, each of the elbows may be fitted at a pair of opposite end portions thereof in the grooves of two associated ones of the metal members and secured to the two associated metal members by means of fastening screws.

Preferably, the circulatory storage apparatus further comprises a hanger bar mounted between the left and rightward side portions of at least one of the circulatory frames by means of a pair of left and right brackets in such a manner as to be positioned outwardly with respect to the left and right side portions in order that clothes hung on such hanger bars on different ones of the circulator frames may not interfere with each other even if the upper and lower endless rails have a comparatively small overall size.

Each of the circulatory frames may be constructed such that the upper, lower and left, right side portions thereof individually have same C-shaped cross sections individually defining nut receiving grooves with inwardly opened slits and a nut having a flexible projection on a rear face thereof is inserted for sliding movement in each of the nut receiving grooves with the flexible projection pressed against an inner face of the nut receiving groove so as to allow a desirable part to be mounted on the upper, lower, left or right side portion of the circulatory frame by screwing a screw into the nut through the part. Thus, when a bearing block, a hanger par or some other part is to be mounted onto a circulatory frame, the nut can be stopped at an arbitrary position with a suitable degree of frictional force sufficient to prevent inadvertent movement of the nut, but the nut can be adjusted readily by hand.

The above and other objects, features and advantages of the present invention will become apparent from the following description and the appended claims, taken in conjunction with the accompanying drawings in which like parts or elements are denoted by like reference characters.

DESCRIPTION OF THE PREFERRED EMBODIMENTS

Figure 1:
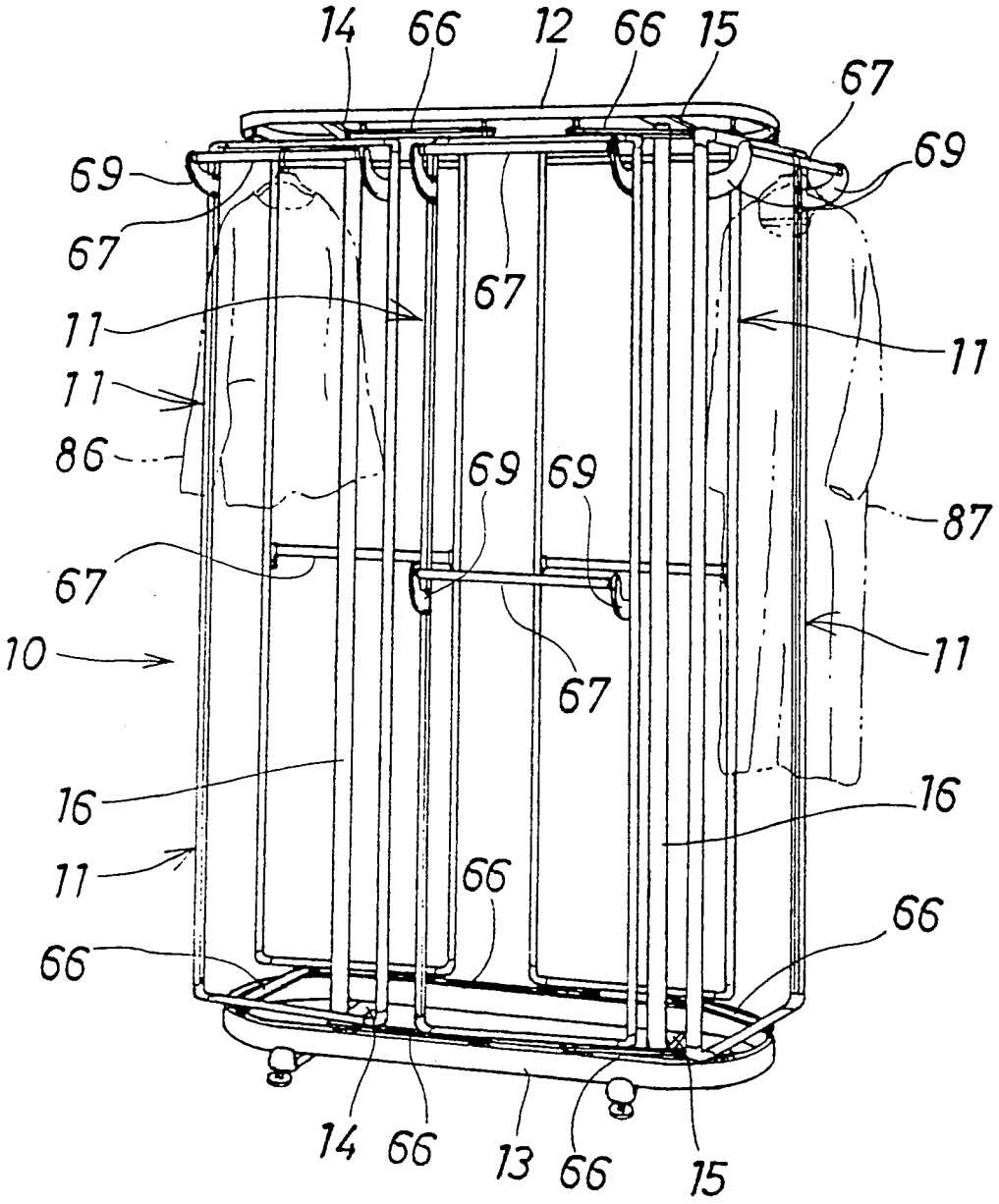
FIG. 1 is a perspective view of an entire circulatory storage apparatus for clothes to which the present invention is applied.
Figure 2:
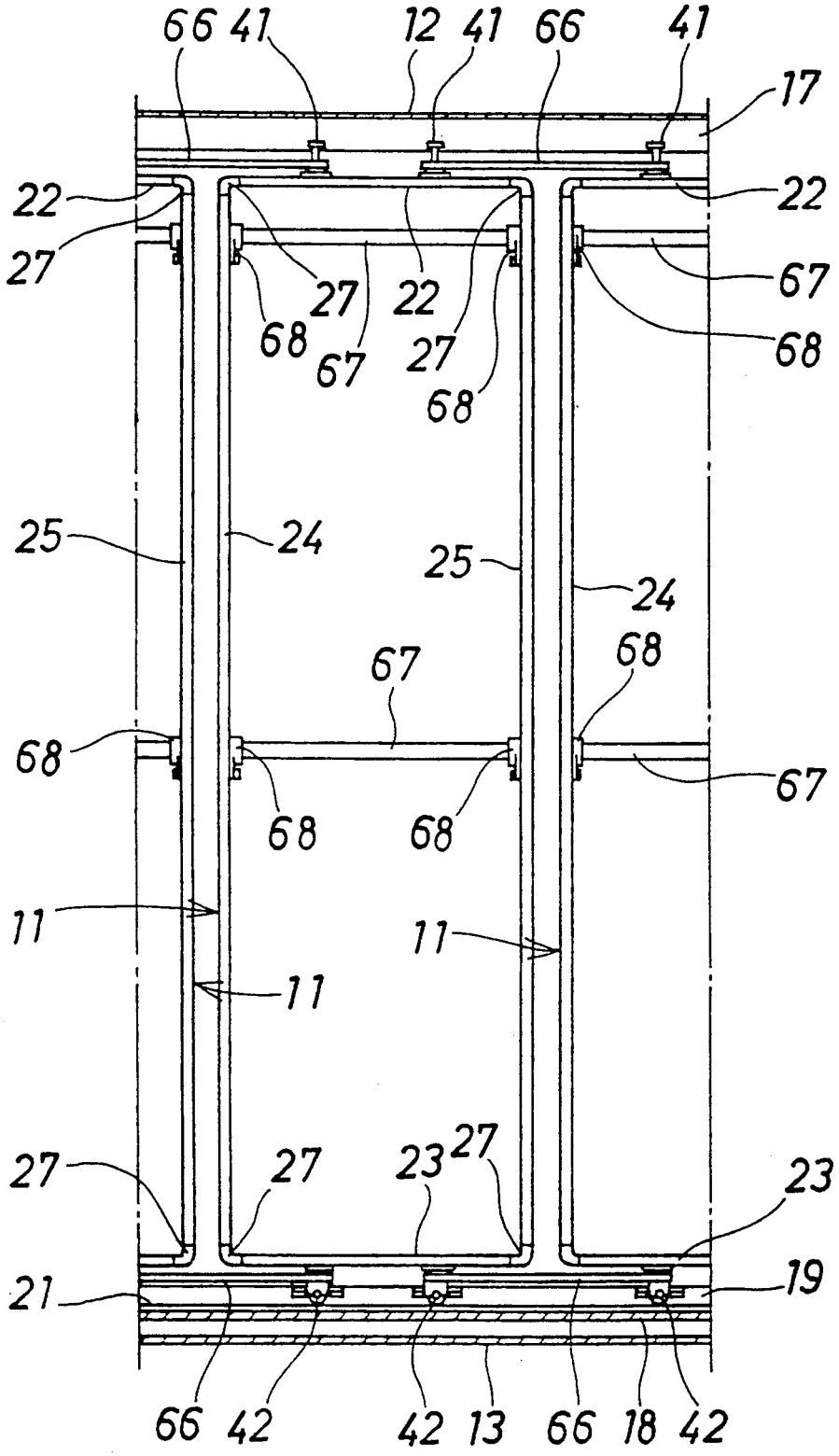
FIG. 2 is a front elevational view, in somewhat enlarged scale, of part of the circulatory storage apparatus.

Referring first to FIGS. 1 and 2, there is shown an entire circulatory storage apparatus to which the present invention is applied. The circulatory storage apparatus is generally denoted at 10 and is constructed suitably for storing clothes therein. The circulatory storage apparatus 10 includes a plurality of, for example, 5, circulatory frames 11, and an upper endless rail 12 of a substantially elliptic shape and a lower endless rail 13 of a similar shape for guiding the circulatory frames 11 thereon. Each of the endless rails 12 and 13 is connected, between parallel front and rear side portions thereof, by a pair of left and right ribs 15, and a pair of left and right vertical stays 16 are connected between the left upper and lower ribs 14 and between the right upper and lower ribs 15. The upper and lower endless rails 12 and 13, left upper and lower ribs 14, right upper and lower ribs 15 and left and right vertical stays 16 cooperatively form a frame of the circulatory storage apparatus 10.

Figure 3:
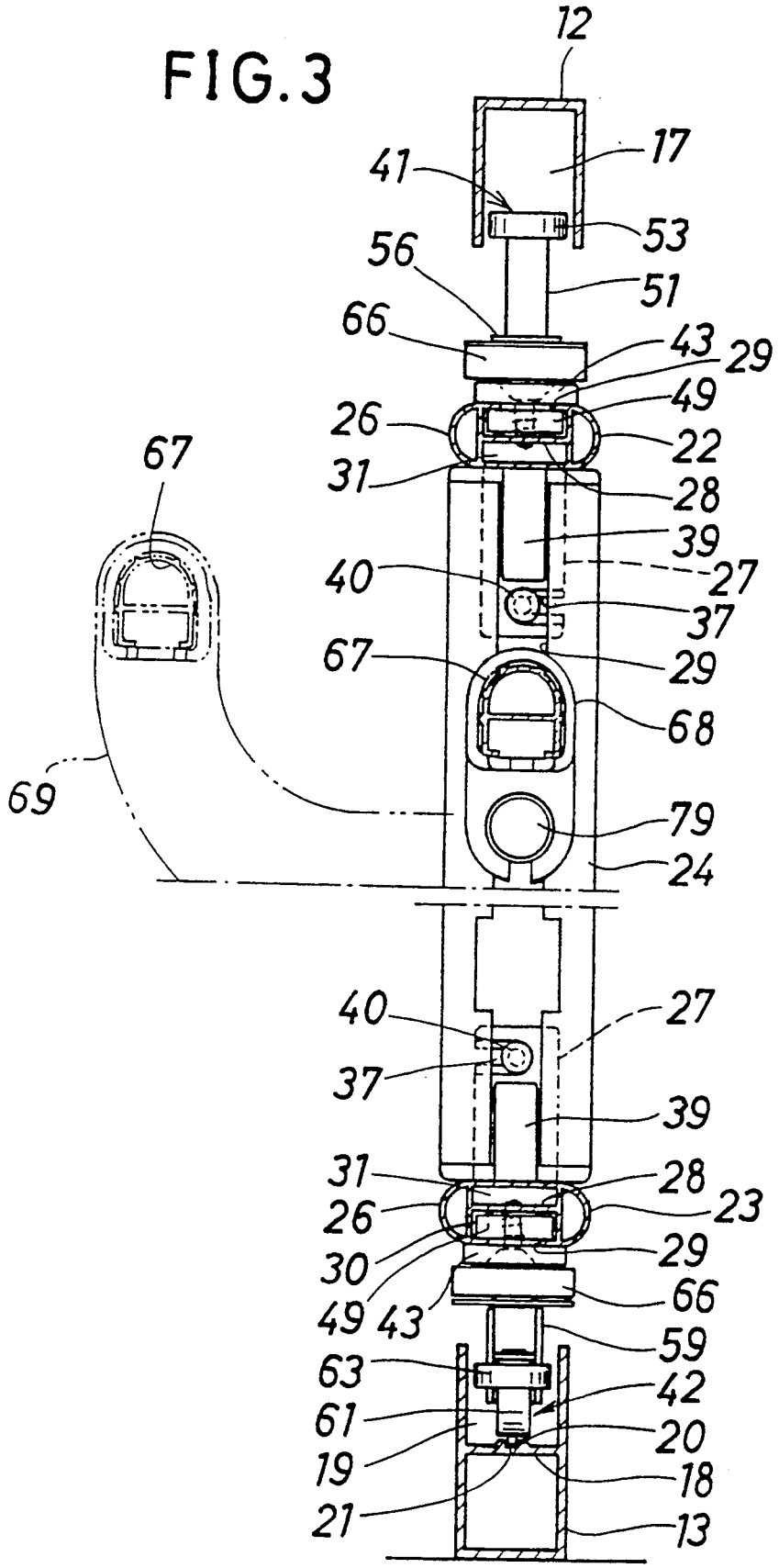
FIG. 3 is a vertical sectional view at a mid position of the circulatory storage apparatus of FIG. 1 in the leftward and rightward direction as viewed in the leftward direction.

Referring now to FIG. 3, the upper endless rail 12 is constituted from a plurality of metal members having an inverted U- or channel-shaped cross section and connected in an endless fashion to each other with the openings thereof directed downwardly, whereby the upper endless rail 12 thus has a downwardly opened endless guide channel 17 formed along an overall circumference thereof. Meanwhile, the lower endless rail 13 is constituted from a plurality of metal members having a U- or channel-shaped cross section and connected in an endless fashion to each other. Each of the metal members has a horizontal intermediate plate 18 at a vertically intermediate portion thereof. Thus, an upwardly opened endless guide channel 19 with the bottom thereof defined by the intermediate plate 18 is formed over the overall circumference of the lower endless rail 13. A narrow and shallow groove 20 is defined at a widthwise central portion of an upper face of the bottom 18 of the guide channel 19 by small and low protrusions or ribs formed along the opposite edges of the groove 20, and a hard wire 21 of steel or a like metal is securely mounted in the groove 20 over the overall circumference of the guide channel 19. The hard wire 21 has an arcuate upper face which extends upwardly above the ribs on the opposite edges of the groove 20.

Figure 4:
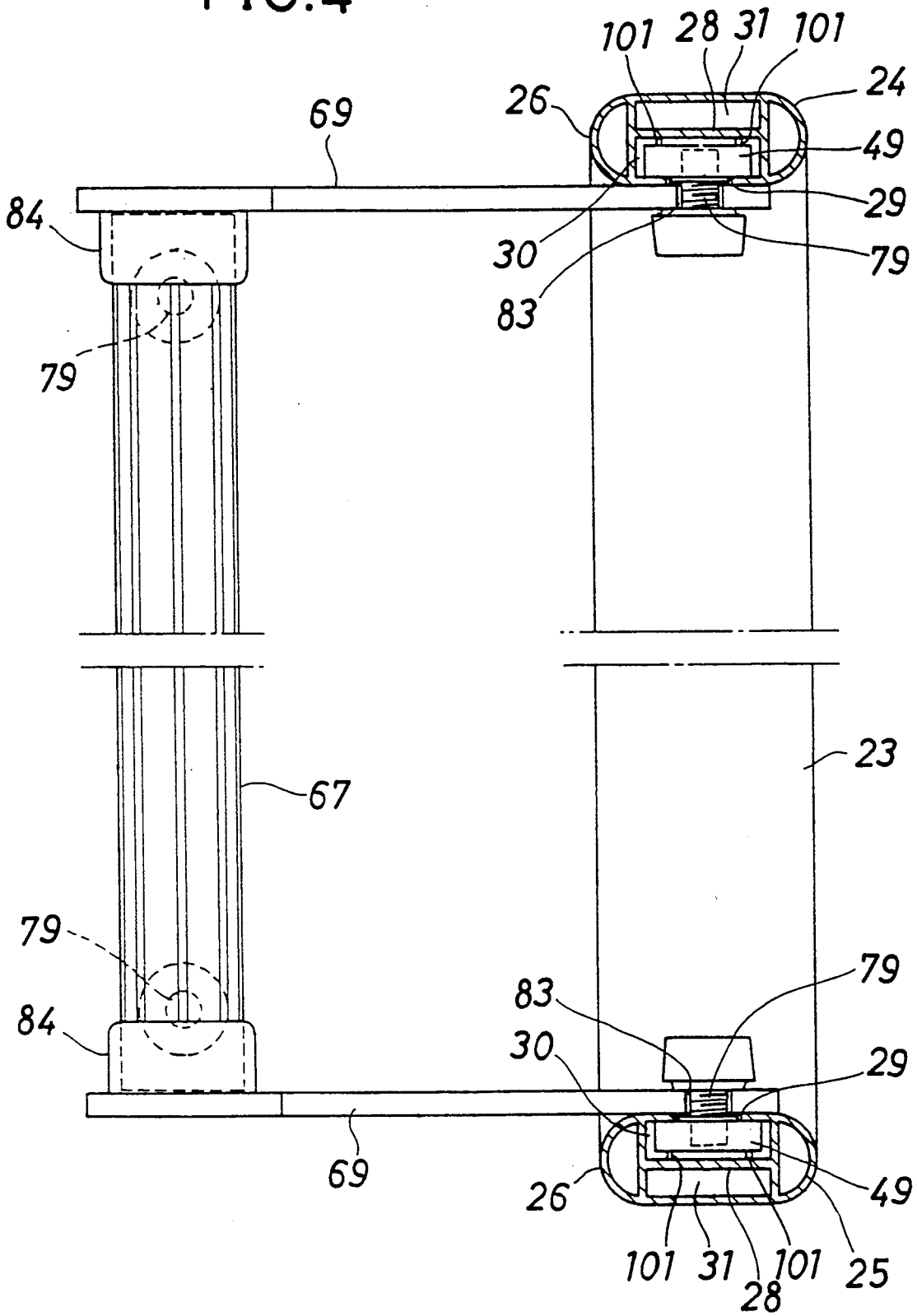
FIG. 4 is an enlarged horizontal sectional view showing one of circulatory frames of the circulatory storage apparatus together with a hanger bar mounted on the circulatory frame by means of a bracket.
Figure 5:
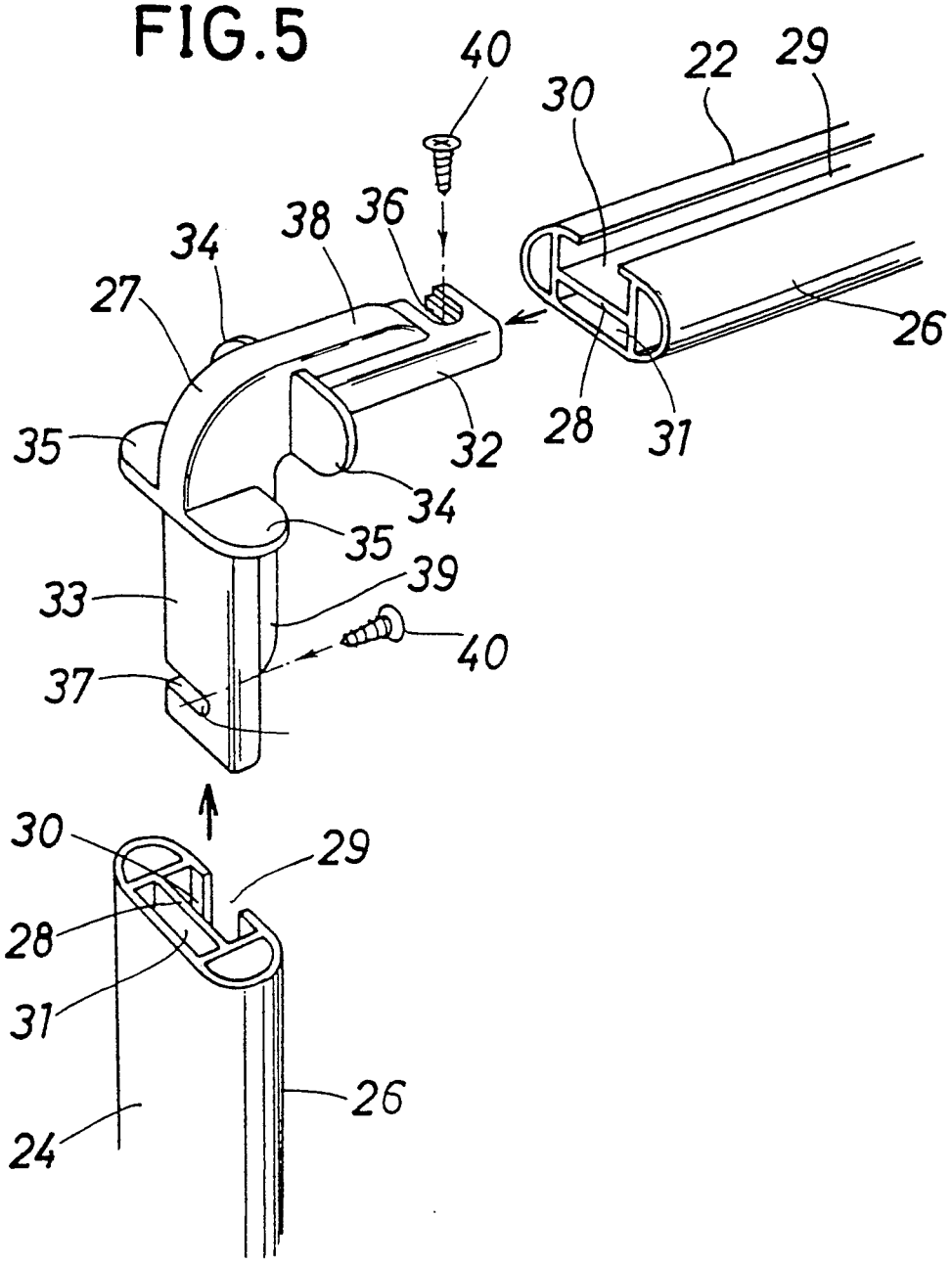
FIG. 5 is an exploded perspective view of an upper side portion and a left side portion of a circulatory frame shown in FIG. 1 and an elbow.

Referring back to FIG. 2, each of the circulatory frames 11 has a generally vertically elongated rectangular profile and includes a pair of minor upper and lower side portions 22 and 23 and a pair of major left and right side portions 24 and 25. The four side portions 22 to 25 of the circulatory frame 11 are individually formed from four such elongated metal members 26 having a substantially same cross section as shown in FIGS. 3 to 5 and interconnected by four L-shaped elbows 27. Each metal member 26 has an outer shell portion having a C-shaped cross section and has a reinforcing rib 28 of an H-shaped cross section provided integrally in the inside of the C-shaped outer shell portion such that a slit 29, a cut receiving groove 30 opened at the slit 29 and a hollow hole 31 are formed over the overall length of the metal member 26.

Each elbow 27 is formed as a unitary molded member of a plastic material as shown in FIG. 5. The opposite arms 32 and 33 of the elbow 27 have pairs of ears 34 and 35 formed at the opposite faces at base end portions thereof and have U-shaped recesses 36 and 37 at side edges at end portions thereof, respectively. The arm 32 has an outer projection 38 formed on an outer face thereof such that it extends from a corner portion of the elbow 27 between the arms 32 and 33 to a portion in the proximity of the recess 36 while the other arm 33 has an inner projection 39 formed on an inner face thereof such that it extends from the corner portion between the arms 32 and 33 to another portion in the proximity of the recess 37. Consequently, the arms 32 and 33 of the elbow 27 can be inserted, at outer portions thereof farther than the ears 34 and 35, into end portions of the nut receiving grooves 30 of the associated metal members 26 such that the outer and inner projections 38 and 39 extend laterally outwardly from the slits 29 of the metal members 26 as seen from FIG. 6.

The circulatory frame 11 composed of the four metal members 26 and the four elbows 27 is assembled in the following manner.

Figure 6:
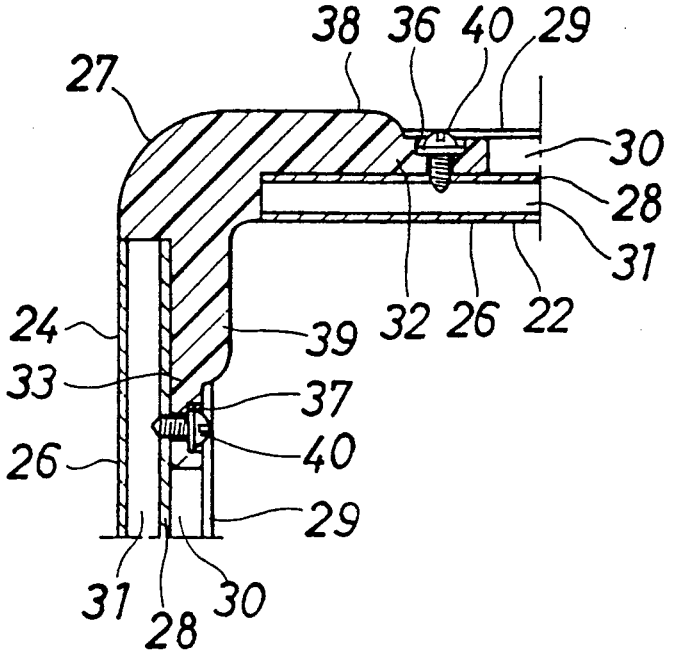
FIG. 6 is a fragmentary enlarged vertical sectional view of connecting portions between the upper side portion and the left side portion and between the left side portion and the lower side portion of the circulatory frame of FIG. 5 by means of the elbows.
Figure 6:
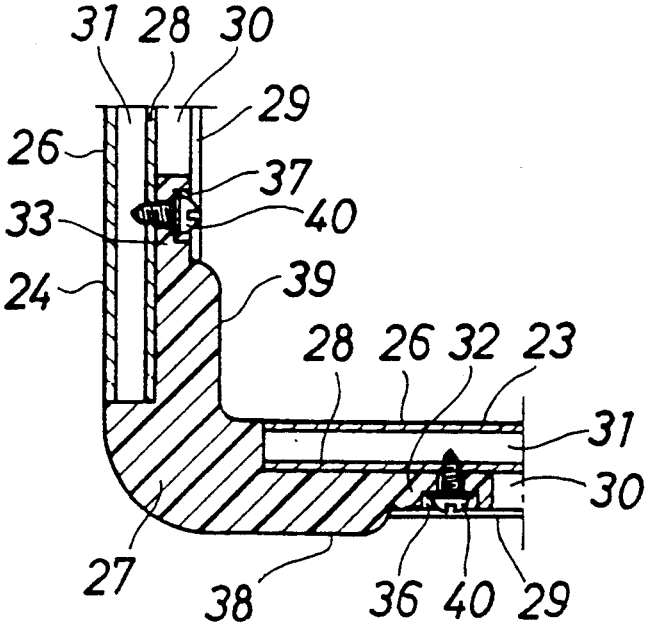

In particular, as seen in FIG. 6, the metal members 26 of the circulatory frame 11 are individually directed such that the metal member 26 for the upper side portion 22 is directed with the slit 29 thereof positioned upwardly; the metal member 26 for the lower side portion 23 is directed with the slit 29 thereof positioned downwardly; and the metal members 26 for the left and right side portions 24 and 25 are directed with the slits 29 positioned inwardly. Then, the four elbows 27 are individually directed such that the outer and inner projections 38 and 39 of the opposite arms 32 and 33 thereof coincide with the directions of the slits 29 of the metal members 26 for the four upper, lower and left, right side portions 22 to 25 of the circulatory frame 11, and the arm 32 of each of the elbows 27 is inserted into the nut receiving groove 30 of the metal member 26 for the upper or lower side portion 22 or 23, whereafter a screw 40 which may be a tapping screw is screwed compulsorily into the reinforcing rib 28 through the recess 36 of the arm 32 to secure the arm 32 to the metal member 26. Then, the other arm 33 is inserted into the nut receiving groove 30 of the metal member 26 for the left or right side portion 24 or 25, and a screw 40 is similarly screwed compulsorily into the reinforcing rib 28 through the recess 37 of the arm 33 to secure the arm 33 to the metal member 26.

Figure 7:
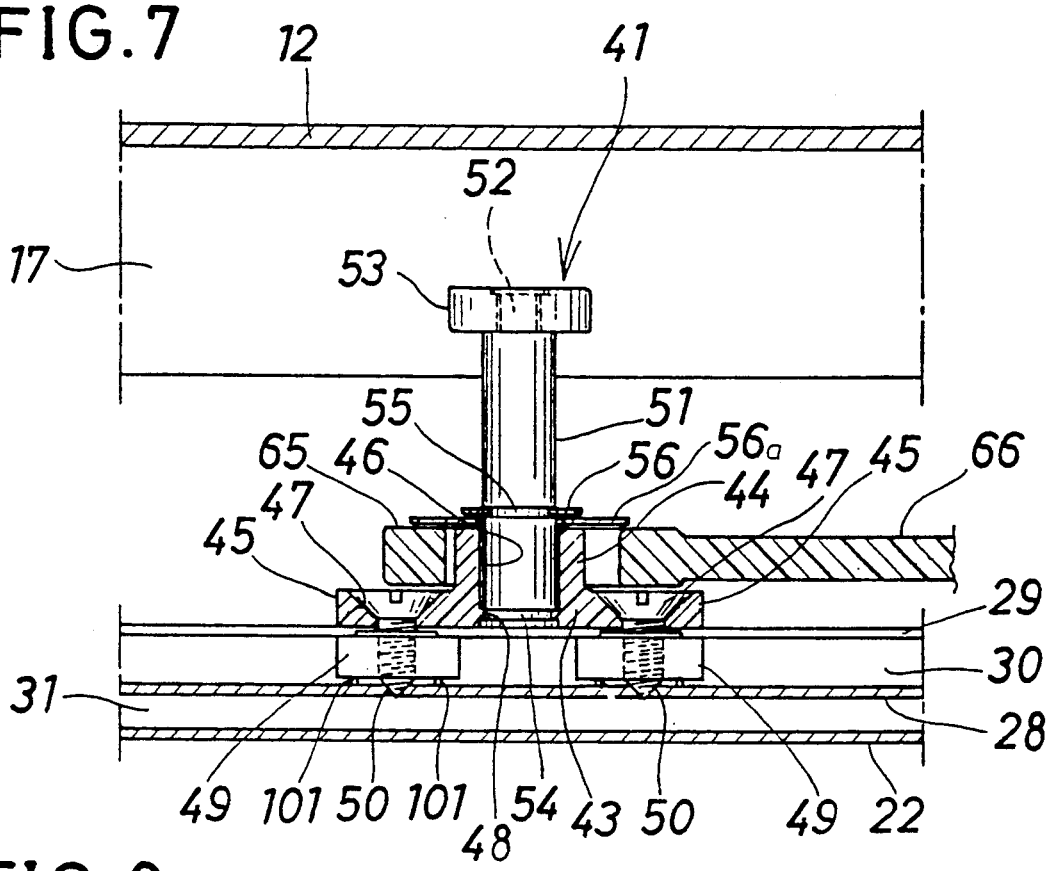
FIG. 7 is an enlarged sectional view showing a mounting structure for an upper guide roller mounted on the upper side portion of a circulatory frame.
Figure 8:
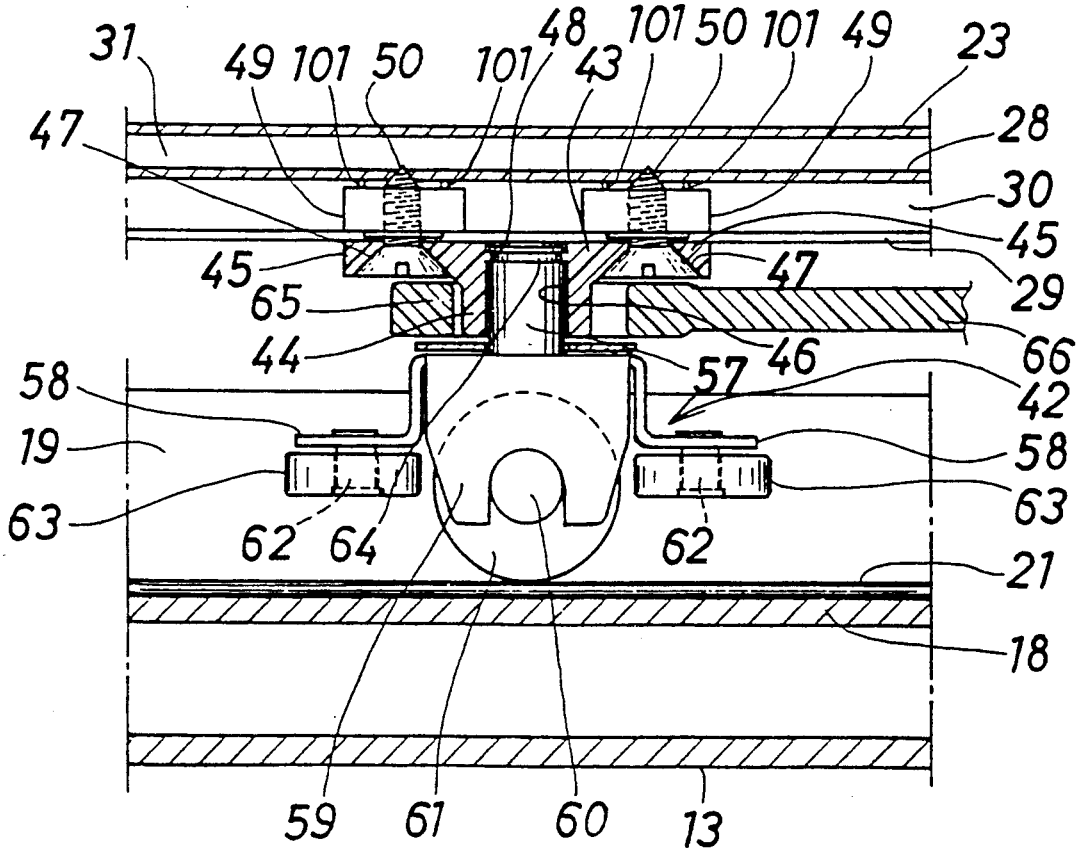
FIG. 8 is an enlarged sectional view showing a mounting structure for a caster mounted at the lower side portion of a circulatory frame.

Referring back again to FIG. 2, a pair of left and right upper guide rollers 41 are mounted on the upper side portion 22 of each of the circulatory frames 11, and a pair of left and right casters 42 are mounted on the lower side portion 23 of each of the circulatory frames 11. A mounting structure for the upper guide rollers 41 is shown in FIG. 7 while a mounting structure for the casters 42 is shown in FIG. 8. Referring to FIGS. 7 and 8, bearing blocks 43 of a same structure are employed commonly for mounting the upper guide rollers 41 and the casters 42. In particular, each of the bearing blocks 43 is formed as a unitary molded body of a plastic material and has a central hub 44 and a pair of left and right flange portions 45. The bearing block 43 has a bearing hole 46 formed therein such that it extends from a rear face thereof to an end of the hub 44, and further has a pair of left and right mounting holes 47 formed therein. A small annular projection or rib 48 is formed at a base end portion of an inner periphery of the bearing hole 46 of the bearing block 43.

The bearing block 43 is secured at two left and right portions thereof to the upper side portion 22 of the circulatory frame 22 with the hub 44 thereof directed upwardly as seen in FIG. 7, but the bearing block 43 is secured at two left and right portions thereof to the lower side portion 23 with the hub 44 directed downwardly as seen in FIG. 8. The bearing blocks 43, however, are secured by a similar securing method. In particular, the bearing block 43 is secured to an upper face of the upper side portion 22 of the circulatory frame 11 by screwing and tightening a pair of screws 50 into a pair of nuts 49, fitted in advance in the nut receiving groove 30 of the upper side portion 22, through the left and right mounting holes 47 of the bearing block 43 and the slit 29 of the upper side portion 22. Meanwhile, the bearing block 43 is secured to a lower face of the lower side portion 23 of the circulatory frame 11 by similarly screwing and tightening a pair of screws 50 into a pair of nuts 49, fitted in advance in the nut receiving groove 30 of the lower side portion 23.

The upper guide roller 41 includes a roller 53 made of a plastic material and supported for rotation at a head 52 of a reduced diameter of a metal shaft 51. The metal shaft 51 has a shallow annular groove 54 formed at a lower portion of an outer periphery thereof and has another annular groove 55 formed at an intermediate portion thereof, and an E-snap ring 56 is snapped in the annular groove 55. The upper guide roller 41 is secured vertically to each of the bearing blocks 43, which are secured to two left and right locations of the upper side portion 22 of the circulatory frame 11, such that a lower portion of the shaft 51 is inserted in the bearing hole 46 of the bearing block 43 until the annular projection 48 of the bearing hole 46 is fitted in the annular groove 54 of the shaft 51 so that the shaft 51 and hence the upper guide roller 51 may not be let off from the bearing hole 46 of the bearing block 43.

Referring to FIG. 8, the caster 42 is composed of a metal frame 59, a metal support roller 61 and a pair of left and right lower guide rollers 63 made of a plastic material. The metal frame 59 has a pivot 57 secured to the center of an upper portion thereof and has a pair of left and right L-shaped wing portions 58 extending leftwardly and rightwardly therefrom. The pivot 57 has a shallow annular groove 64 formed at an upper end portion of an outer periphery thereof. The metal support roller 61 is supported for rotation on a horizontal axle 60 secured to the metal frame 59. The lower guide rollers 63 are supported for rotation on a pair of left and right roller shafts 62 securely mounted on and extending vertically upwardly from the left and right wing portions 58 of the metal frame 59. The caster 42 is mounted for turning motion around a vertical axis on each of the bearing blocks 43, which are secured to two left and right locations of the lower side portion 23 of the circulatory frame 11, such that the pivot 57 is inserted in the bearing hole 46 of the bearing block 43 until the annular projection 48 of the bearing hole 46 is fitted in the annular groove 64 of the pivot 57 so that the pivot 57 and hence the caster 42 may not be let off from the bearing hole 46 of the bearing block 43.

Figure 9:
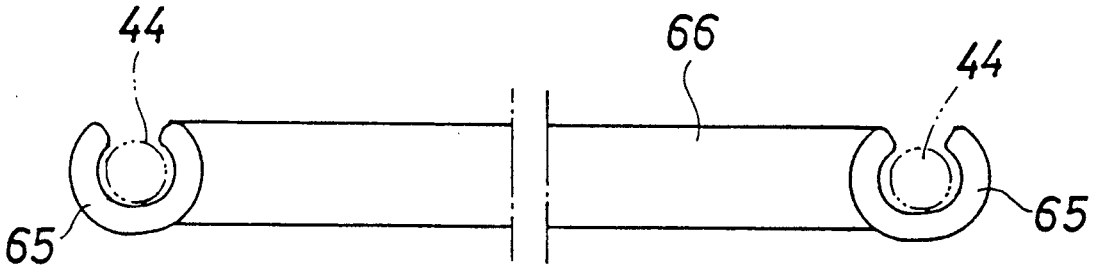
FIG. 9 is a plan view of a link for interconnecting circulatory frames.

The five circulatory frames 11 each having the two left and right upper guide rollers 41 and the two left and right casters 42 mounted thereon are disposed in a horizontal circular row between the upper and lower endless rails 12 and 13 such that the rollers 53 of the upper guide rollers 41 are positioned in the guide channel 17 of the upper endless rail 12 and the support rollers 61 and the left and right lower guide rollers 63 of the casters 42 are positioned in the guide channel 19 of the lower endless rail 13. Each two adjacent ones of the circulatory frames 11 are interconnected such that the left bearing block 43 of the upper side portion 22 of one of the two circulatory frames 11 and the right bearing block 43 of the upper side portion 22 of the other circulatory frame 11 are connected to each other by means of a link 66 having a pair of C-shaped hooks 65 at the opposite ends thereof as shown in FIG. 9 and also the left bearing block 43 of the lower side portion 23 of the one circulatory frame 11 and the right bearing block 43 of the lower side portion 23 of the other circulatory frame 11 are connected to each other by means of another similar link 66. In such connection, the hooks 65 of each link 66 are removably engaged with outer peripheries of the hubs 44 of the associated bearing blocks 43. It is to be noted that the shaft 51 of each of the upper guide rollers 41 has a washer **56*a* fitted at a portion thereof below the E-snap ring 56 so that the associated hook 65 of the link 66 may not be removed inadvertently from the hub 44 of the bearing block 43**.

Thus, the five circulatory frames 11 are all connected in an endless fashion to each other by the five upper and five lower links 66, and consequently, if one of the circulatory frames 11 is manually moved along the upper and lower endless rails 12 and 13, the other four circulatory frames 11 are moved by the one circulatory frame 11 along the upper and lower endless rails 12 and 13 so that all of the circulatory frames 11 are circulated along the upper and lower endless rails 12 and 13. In this instance, since the support rollers 61 of the casters 42 are rolled in a point contacting condition on the hard wire 21 in the guide channel 19 of the lower endless rail 13 while supporting the loads of the circulatory frames 11 from below, the circulatory frames 11 can be moved light. Further, since the casters 42 can each be pivoted as a whole around the pivot 57 and besides the left and right lower guide rollers 63 of the casters 42 can be rolled along inner side faces of and in the guide channel 19 of the lower endless rail 13 while also the rollers 53 of the upper guide rollers 41 can be rolled along inner side faces of and in the guide channel 17 of the upper endless rail 12, the circulatory frames 11 can move smoothly along the curved portions of the upper and lower endless rails 12 and 13.

An arbitrary number of hanger bars 67 can be mounted at arbitrary vertical positions on and between the left and right side portions 24 and 25 of each of the circulatory frames 11 each by means of a pair of left and right sockets 68 as shown in FIG. 2 or a pair of left and right L-shaped brackets 69 as shown in FIG. 1.

Figure 10:
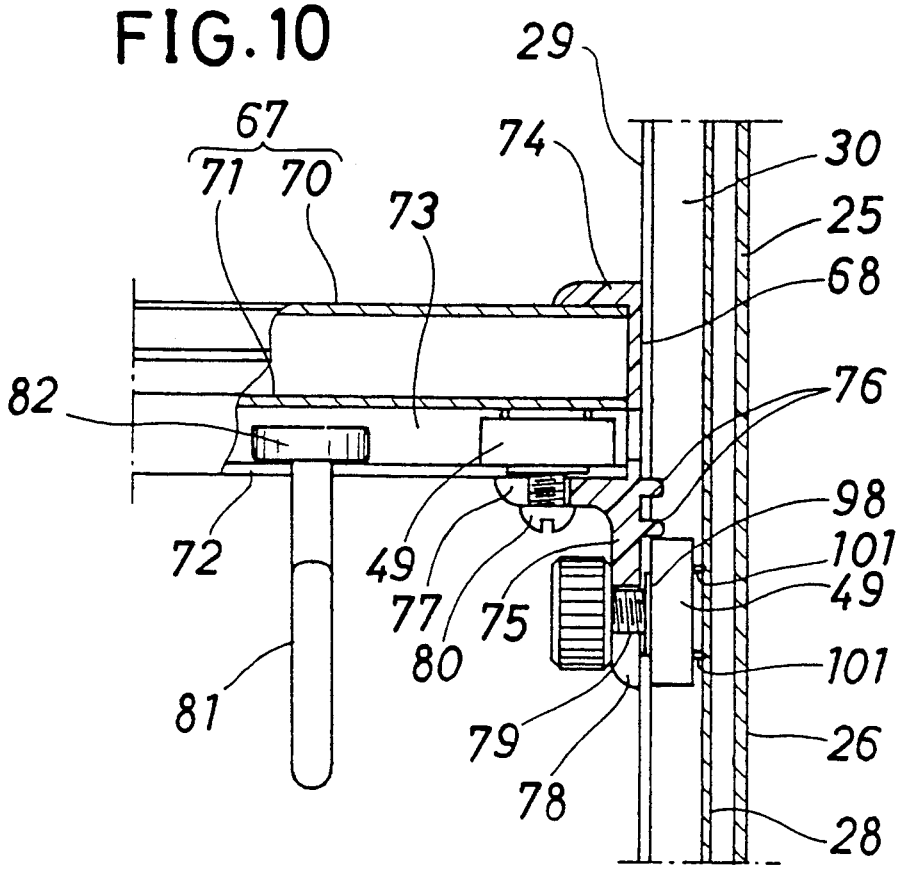
FIG. 10 is an enlarged vertical sectional view showing a supporting structure for a hanger bar on the right side portion of a circulatory frame.
Figure 11:
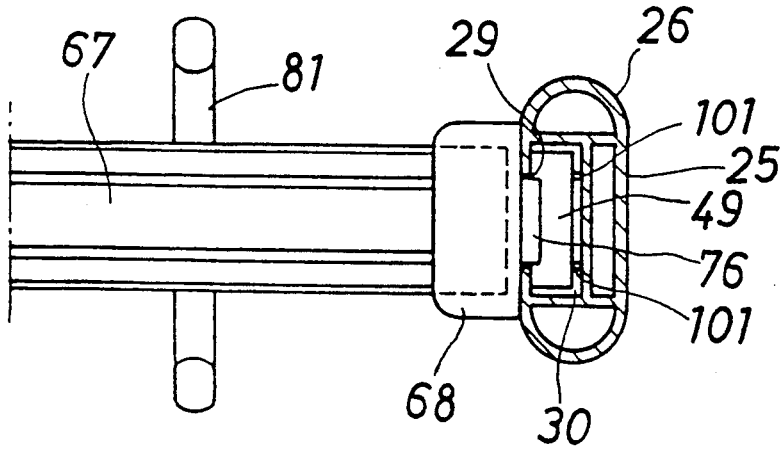
FIG. 11 is a horizontal sectional view of the supporting structure shown in FIG. 10.
Figure 12:
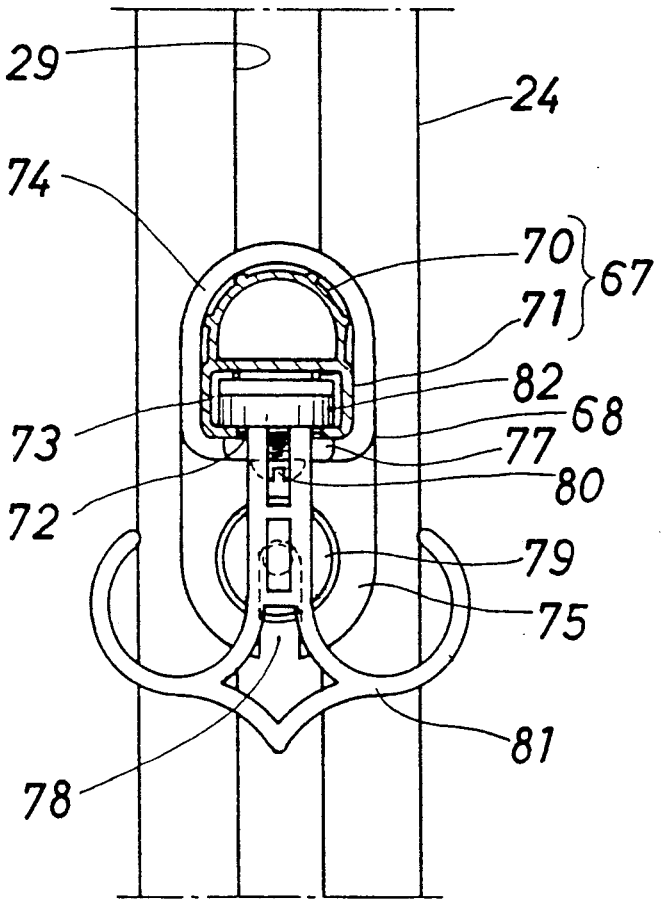
FIG. 12 is an enlarged side elevational view showing an anchor-shaped hanger mounted on a hanger bar together with part of the right side portion of a circulatory frame.

Referring now to FIGS. 10 to 12, a hanger bar 67 mounted between the left and right side portions 24 and 25 of a circulatory frame 11 using a pair of sockets 68 is shown in detail. The hanger bar 67 shown has an upper hollow portion 70 having a semicircular cross section and a lower hollow portion 71 having a C-shaped cross section with a slit 72 formed at a lower side thereof. The lower hollow portion 71 defines a groove 73 having the same size as the nut receiving grooves 30 of the metal members 26 constituting the upper, lower and left, right side portions 22 to 25 of the circulatory frame 11. Each of the sockets 68 is formed as a unitary molded member of a plastic material and has a mouth portion 74 which can removably receive an end portion of a hanger bar 67 therein, a fixing portion 75 extending downwardly from the mouth portion 74, and a pair of upper and lower projections 76 extending rearwardly from the fixing portion 75. A pair of recesses 77 and 78 are formed at a lower peripheral portion of the mouth portion 74 and the fixing portion 75, respectively.

The sockets 68 are secured to the left and right side portions 24 and 25 of the circulatory frame 11 and a hanger bar 67 is secured to the left and right sockets 68 in the following manner. In particular, the projections 76 of each of the sockets 68 are fitted into the slit 29 of the metal member 26 of the left or right side portion 24 or 25 of the circulatory frame 11, and then a screw 69 with a knob is screwed and tightened into a nut 49, inserted in advance in the nut receiving groove 30, through the recess 78 of the socket 68 and the slit 29 of the metal member 26. Then, the opposite ends of a hanger bar 67 are fitted into the mouth portions 74 of the left and right sockets 68 thus secured to the left and right side portion 24 and 25, and screws 80 are screwed and tightened into nuts 49, inserted in prior in the groove 73 of the hanger bar 67, through the recesses 77 of the sockets 68 and the slits 72 of the hanger bar 67. Since the left and right sockets 68 can be secured at arbitrary positions of the left and right side portions 24 and 25 of the circulatory frame 11, the vertical position of the hanger bar 67 can be adjusted arbitrarily.

An anchor-shaped hanger 81 on which a necklace, a bracelet, a watch or a like article can be hung can be received in the groove 73 of the hanger bar 73. The hanger 81 has a disk-shaped head 82 at an upper end thereof and is inserted at the disk-shaped head 82 thereof for sliding movement in the groove 73 so that it can be moved leftwardly and rightwardly along the slit 72 of the hanger bar 67.

Figure 13:
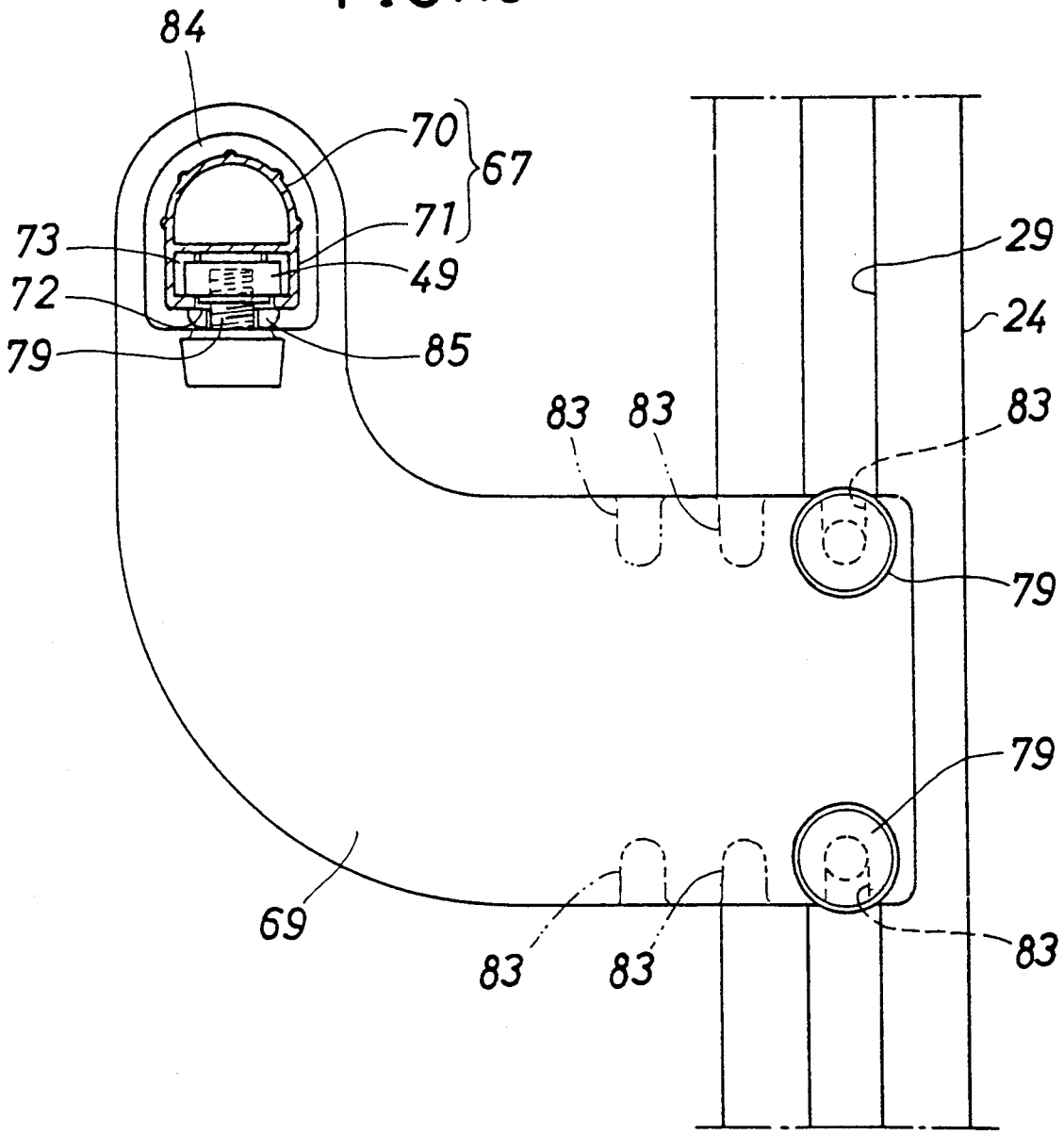
FIG. 13 is an enlarged side elevational view showing a mounting structure for a hanger bar mounted on the left or right side portion of a circulatory frame by means of a bracket.

Referring now to FIGS. 4 and 13, a hanger bar 67 mounted between the left and right side portions 24 and 25 of a circulatory frame 11 using a pair of L-shaped brackets 69 is shown in detail. Each of the brackets 69 has a pair, or as shown in FIG. 13, a plurality of pairs, of U-shaped recesses 83 formed along upper and lower edges of a base end portion thereof and has a mouth portion 84 provided integrally at an end (upper end) portion thereof in such a manner as to removably receive an end portion of a hanger bar 67. An additional U-shaped recess 85 is provided along a lower periphery of the mouth portion 84.

The brackets 69 are secured, similarly to the sockets 68 described above, to the left and right side portions 24 and 25 of a circulatory frame 11 by screwing and tightening screws 79 with a knob into nuts 49 in the nut receiving grooves 30 of the left and right side portions 24 and 25 of the circulatory frame 11. Also the hanger bar 67 is secured, similarly as in the case wherein the sockets 68 are employed, to the left and right brackets 69 by screwing and tightening screws 79 with a knob into nuts 49 inserted in the groove 73 of the hanger bar 67.

Figure 14:
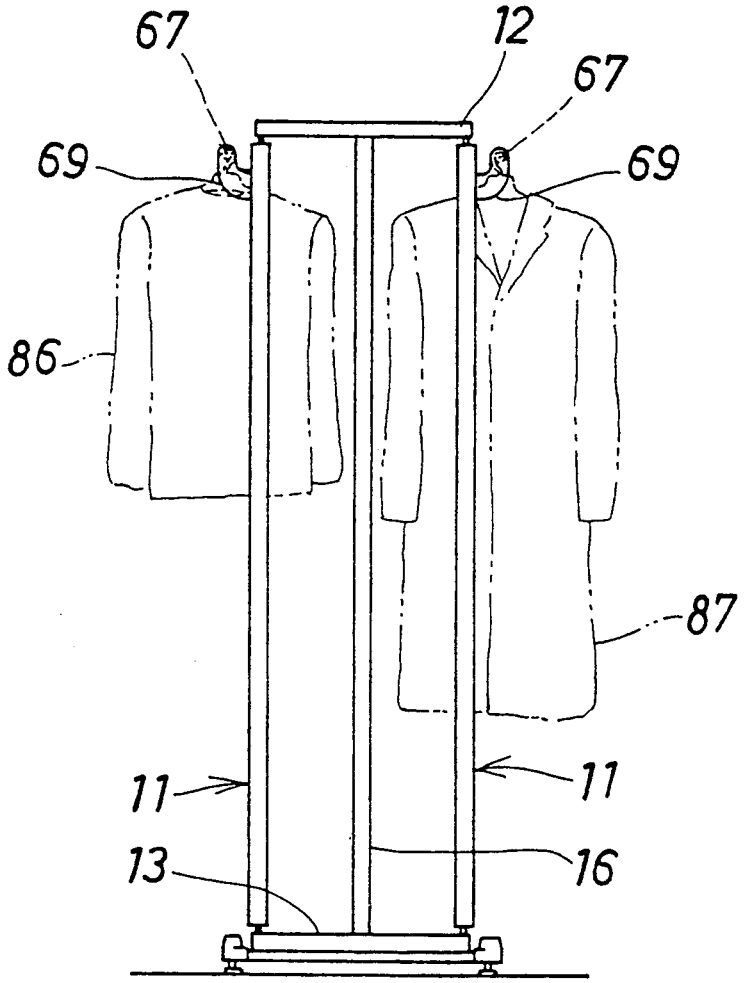
FIG. 14 is a side elevational view showing clothes which are spaced apart, when they are hung on the hanger bars as shown in FIG. 13, from each other on the circulatory frames which are positioned in an opposing relationship on the front and rear of the circulatory storage apparatus.

When the hanger bar 67 is mounted between the left and right side portions 24 and 25 of the circulatory frame 11 by means of the left and right brackets 69, since the hanger bar 67 can be projected outwardly farther than the left and right side portions 24 and 25, the distance between the hanger bars 67 of the circulatory frames 11 at front and rear opposing portions of the upper and lower endless rails 12 and 13 as shown in FIG. 14 is greater than that when the hanger bars 67 are otherwise mounted by means of the sockets 68. Consequently, the possibility that clothes 86 and 87 hung on the hanger bars 67 of the circulatory frames 11 at the front and rear opposing positions interfere with each other. Further, when a plurality of U-shaped recesses 83 are formed in a spaced relationship along the upper and lower edges of the brackets 69 as shown in FIG. 13, the extent to which the hanger bars 67 project from the left and right side portions 24 and 25 can be adjusted depending upon which ones of the U-shaped recesses 83 are used to secure the brackets 69 to the left and right side portions 24 and 25.

Figure 15:
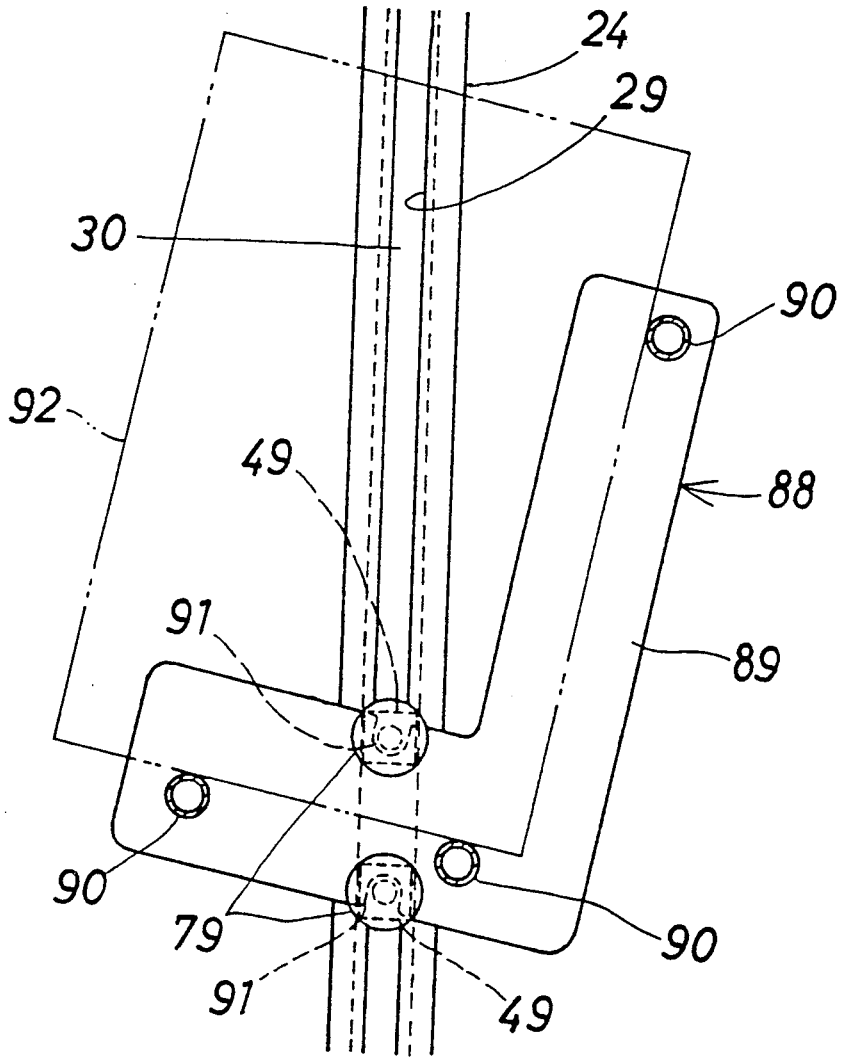
FIG. 15 is an enlarged side elevational view showing a mounting structure for a rack mounted between the left and right side portions of a circulating frame.

Such a rack 88 as shown in FIG. 15 may be mounted between the left and right side portions 24 and 25 of a circulatory frame 11. The rack 88 includes a pair of left and right L-shaped side plates 89 (only the left one is shown) and three bars 90 extending horizontally between the left and right side plates 89 and disposed at the opposite end portions and corner portions of the left and right side plates 89. A pair of U-shaped recesses 91 are formed along upper and lower edges of the lower portion of each of the side plates 89. By inserting and tightening screws 79 with a knob into nuts 49 in the nut receiving grooves 30 of the left and right side portions 24 and 25 of the circulatory frame 11 through the upper and lower recesses 91 of the left and right side plates 89 in a similar manner as in securing of the brackets 69, the rack 88 is secured to the left and right side portions 24 and 25 with the left and right side plates 89 thereof inclined obliquely. Thus, a large number of rectangular articles 92 such as books or video tape cassettes can be received uprightly on the rack 88 while being received by the three bars 90.

Figure 16:
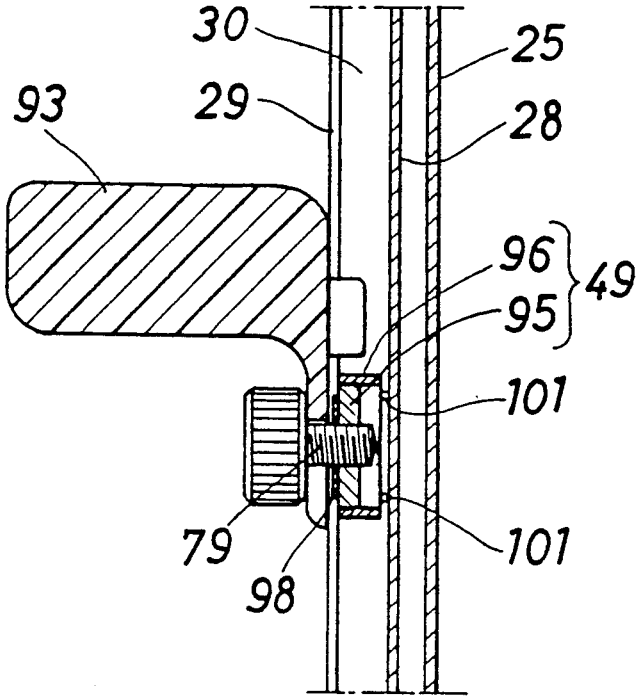
FIG. 16 is an enlarged vertical sectional view showing a mounting structure for a necktie hanger mounted on the right side portion of a circulatory frame.
Figure 17:
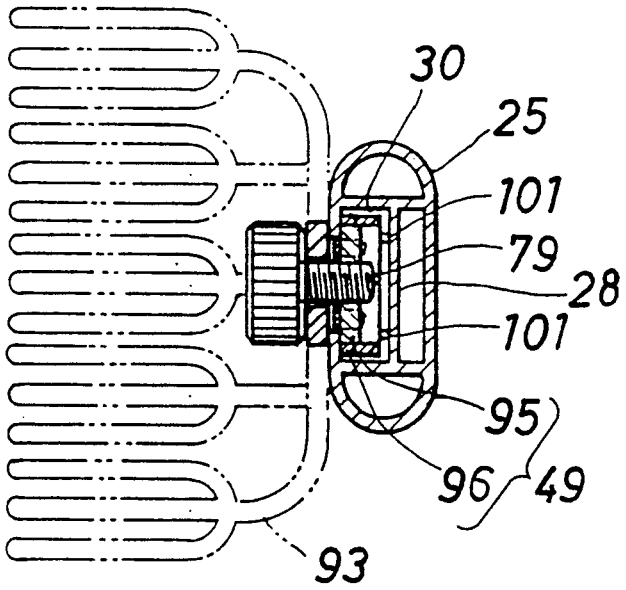
FIG. 17 is a horizontal sectional view of the mounting structure shown in FIG. 16.

Further, such a necktie hanger 93 as shown in FIGS. 16 and 17 can be mounted at an arbitrary position of each of the left and right side portions 24 and 25 of a circulatory frame 11 using a nut 49 and a screw 79 with a knob similarly as described above.

Figure 18:
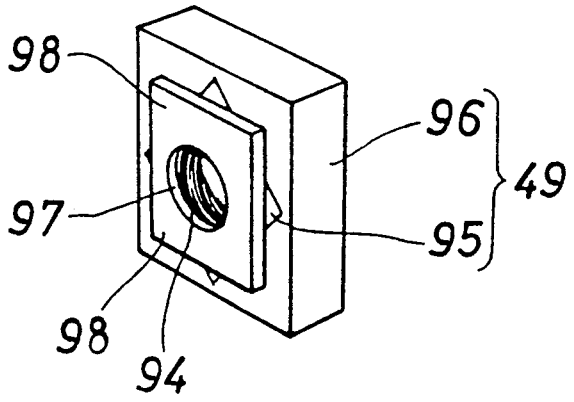
FIG. 18 is a front elevational perspective view of a nut adapted to be inserted into the upper, lower, left and right side portions of a circulatory frame.
Figure 19:
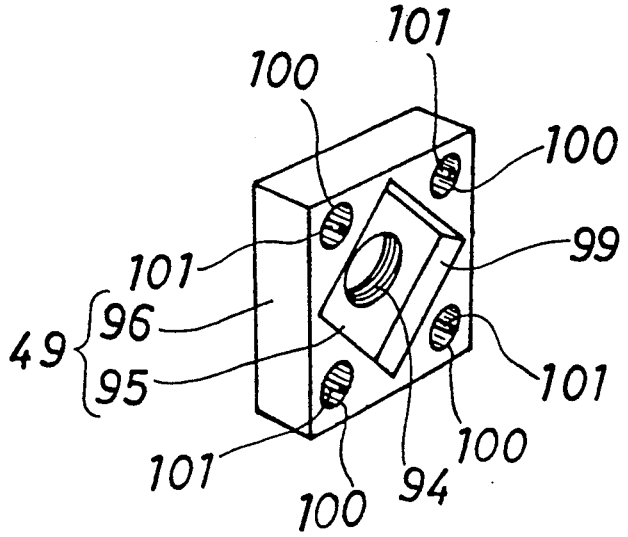
FIG. 19 is a rear elevational perspective view of the nut of FIG. 18.

Referring now to FIGS. 18 and 19, there is shown a nut 49 adapted to be fitted into the nut receiving groove 30 of the upper, lower and left, right side portions 22, 23, 24 and 25 of the circulatory frame 11 as described above to secure various parts to them. The nut 49 includes a metal piece 95 having a threaded hole formed at the center thereof and a square plastic block 96 in which the metal piece 95 is buried. The plastic block 96 has integrally formed at the front thereof a square projection 98 in which a hole 97 communicating with the threaded hole 94 is formed. A square window 99 is formed on the rear face of the plastic block 96 such that it exposes a central portion of the metal plate 95 therethrough, and four circular holes 100 are formed at the four corners of the rear face of the plastic block 96. A flexible pin 101 is formed integrally at the center of the bottom of each of the circulator holes 100 and extends at an end portion thereof a little farther than the opening of the circular hole 100.

Figure 20:
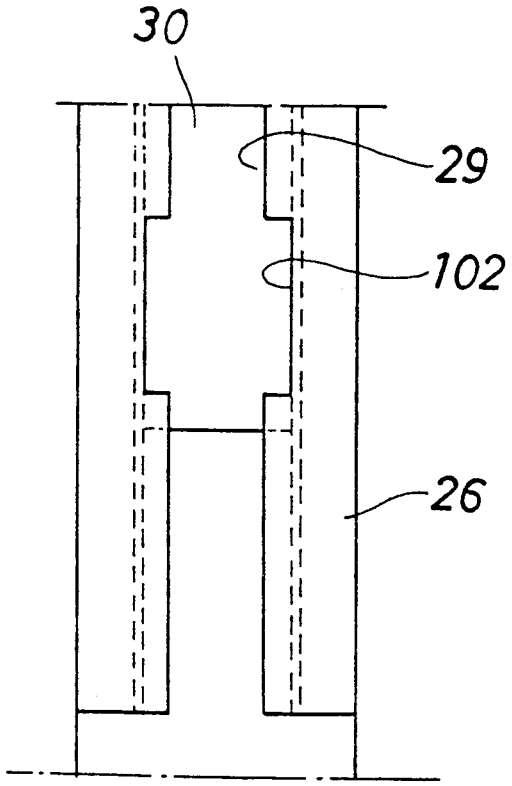
FIG. 20 is a side elevational view showing a nut insertion hole in which the nut is to be inserted.

In order to allow the nut 49 to be inserted into the nut receiving groove 30, each of the metal members 26 constituting the upper, lower and left, right side portions 22, 23, 24 and 25 of the circulatory frame 11 has at least one nut entrance 102 which partially increases the width of the slit 29 as shown in FIG. 20. The nut 49 inserted in the nut receiving groove 30 exhibits a similar mounted condition to any of the upper, lower and left, right side portions 22, 23, 24 and 25. In particular, since, for example, as shown in FIGS. 16 and 19, the nut 49 can slidably move along the slit 29 with the projection 98 thereof fitted in the slit 29 and ends of the four pins 101 are pressed against an inner bottom face of the nut receiving groove 30 (surface of the reinforcing rib 28), the nut 49 can be stopped by itself at an arbitrary position while it is prevented from inadvertent movement with respect to the nut receiving groove 30.

Figure 21:
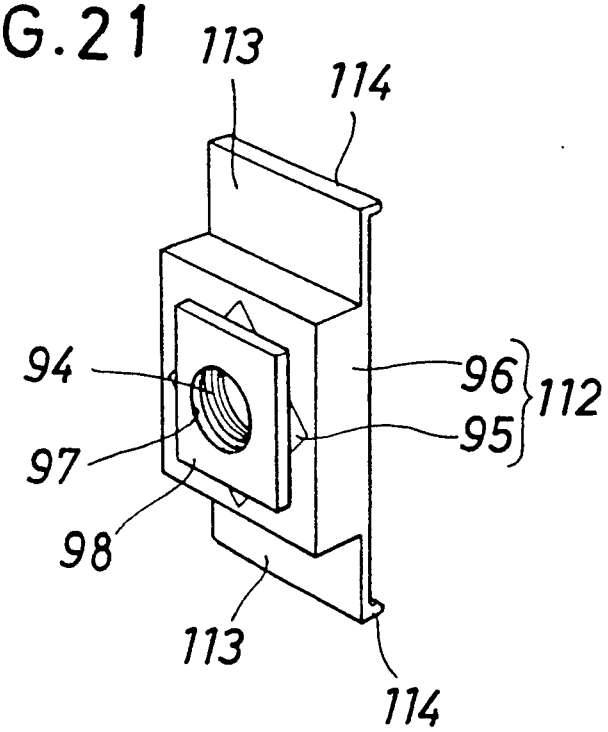
FIG. 21 is a perspective view showing a modification to the nut shown in FIG. 18.

FIG. 21 shows a modification to the nut 49. Referring to FIG. 21, the modified nut denoted at 112 has a plastic block 96 having a pair of extensions 113 each in the form of a flexible plate formed on the opposite sides of the plastic block 96. A lateral rib 114 is formed at an end edge of each of the extensions 113 of the plastic block 96 in place of the pins 101 described above.

Figure 22:
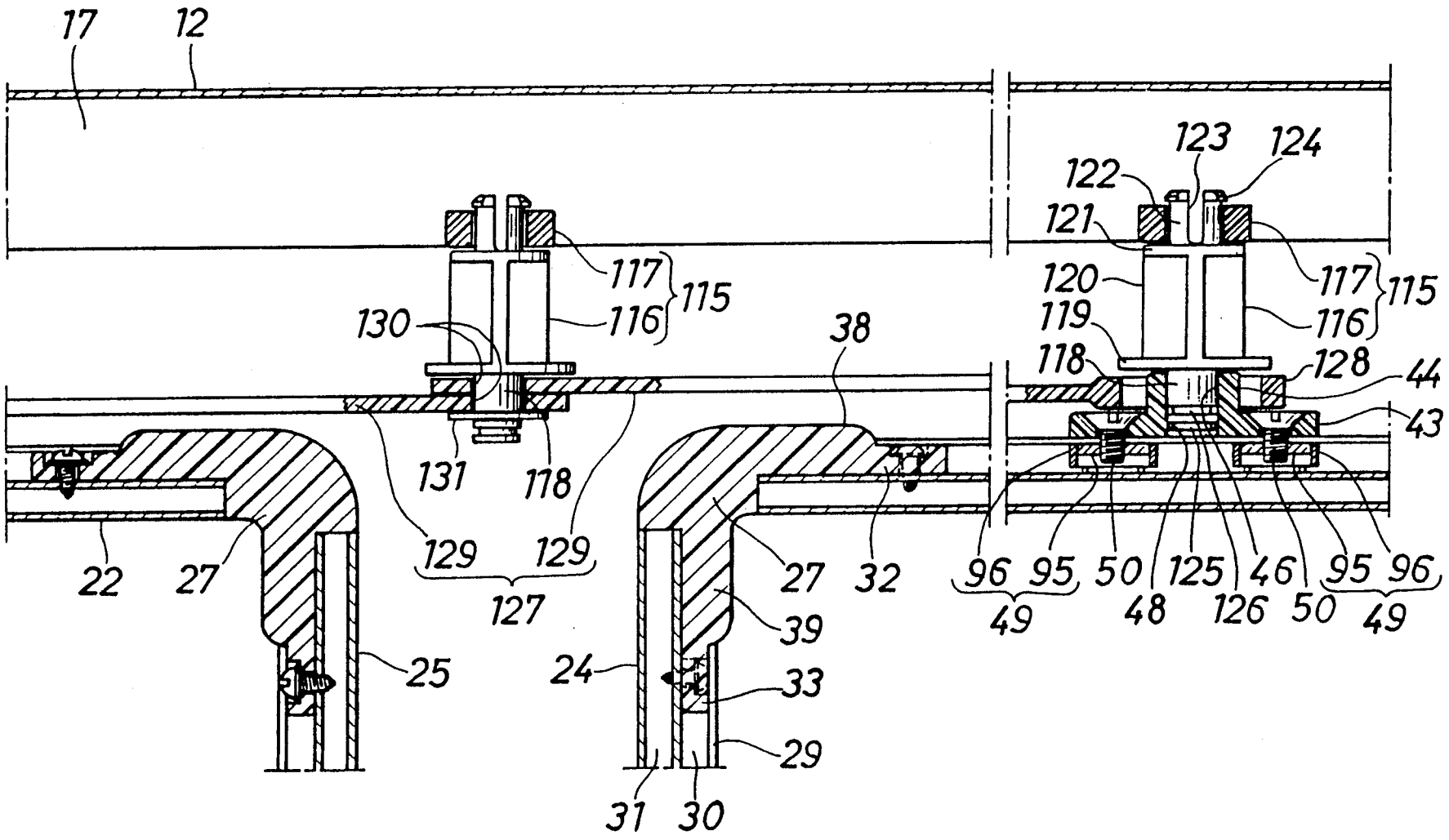
FIG. 22 is a vertical sectional view showing a modified upper link for interconnecting circulatory frames at the upper side portions thereof together with a modified upper guide roller.
Figure 23:
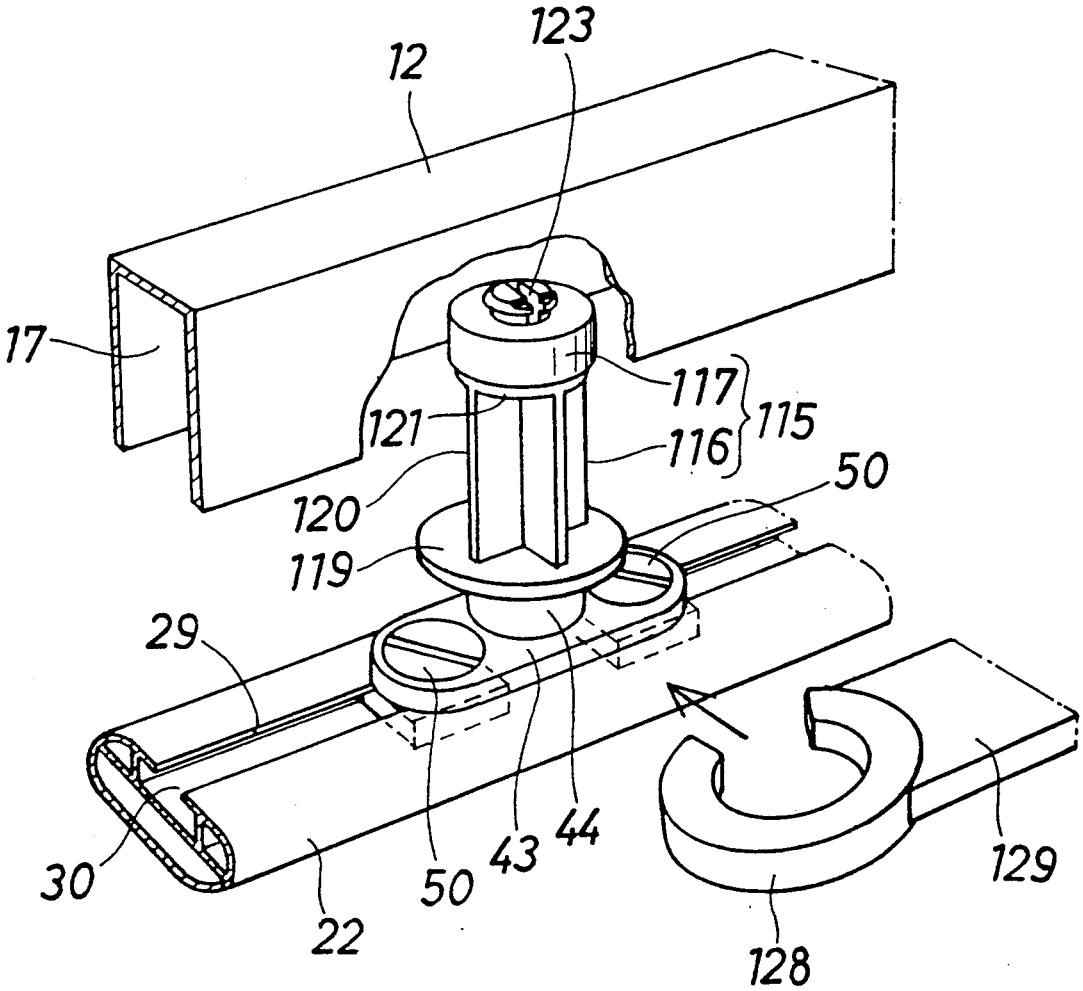
FIG. 23 is a perspective view showing the upper link and the upper guide roller shown in FIG. 22.
Figure 24:
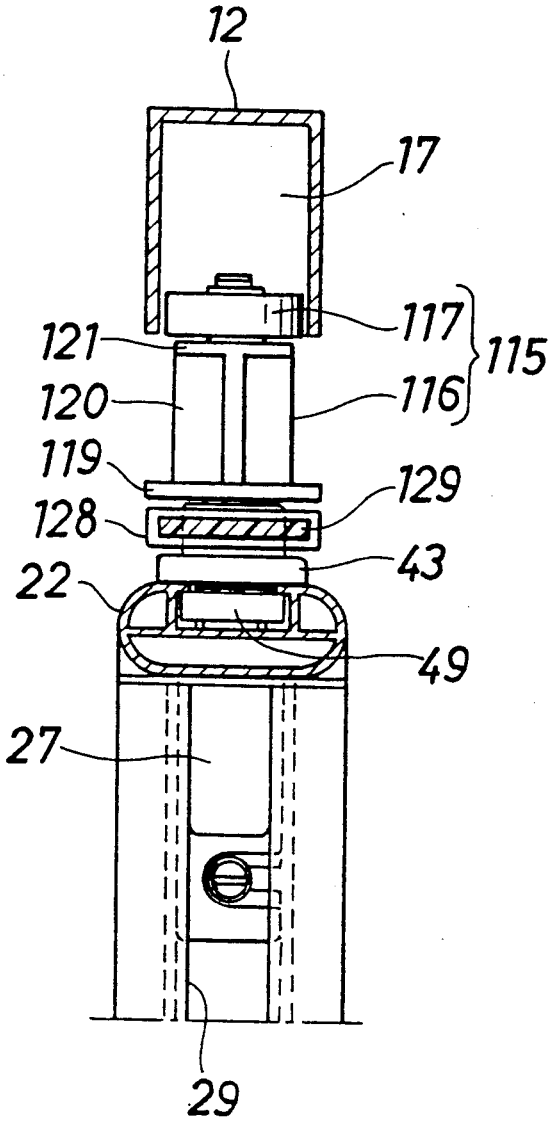
FIG. 24 is a side elevational vertical sectional view of the upper link and the upper guide roller shown in FIG. 22 taken along a mid portion as viewed in the leftward direction.

Referring now to FIGS. 22 to 24, there is shown a modified upper link for interconnecting circulatory frames at the upper side portions thereof together with a modified upper guide roller. The upper guide roller 115 shown includes a core 116 formed as a unitary molded member from a plastic material and a roller 117 made of a plastic material. The core 116 has a lower shaft portion 118, a lower flange portion 119, an intermediate portion 120 having an X-shaped cross section, an upper flange portion 121 and an upper shaft portion 122. A slit 123 and an annular projection 124 are formed at the upper shaft portion 122 of the core 116, and a pair of shallow annular grooves 125 and 126 are formed on an outer periphery of the lower shaft portion 118. The roller 117 is fitted compulsorily on the upper shaft portion 122 so that it is supported for rotation while letting off thereof from the upper shaft portion 122 is prevented by the annular projection 124. The lower shaft portion 118 of the core 116 is inserted in the bearing hole 46 of the bearing block 43 secured to the upper side portion 22 of the circulatory frame 11 until the groove 125 thereon is fitted with the annular projection 48 of the bearing hole 46 so that the upper guide roller 115 is mounted vertically on the bearing block 43 while prevented from being let off from the bearing hole 46 and the roller 117 is positioned in the guide channel 17 of the upper endless rail 12.

The modified upper link 127 shown in FIGS. 22 to 24 includes a pair of plastic members 129 each having a C-shaped hook 128 at an end thereof and connected to each other by an upper guide roller 115 substantially similar to the upper guide roller 115 mounted on the bearing block 43. At the connection, the other end portions of the plastic members 129 are placed one on the other such that holes 130 thereof may be aligned with each other, and the lower shaft portion 118 of the upper guide roller 115 is fitted in the thus aligned holes 130 of the plastic members 129. An E-snap ring 131 is fitted in the annular groove 126 of the lower shaft portion 118 of the upper guide roller 115 so that the upper guide roller 115 may not be let off from the holes 130 of the plastic members 129. One or each of the two plastic members 129 is bent in the vertical direction at an intermediate portion thereof to form an offset portion (not shown) so that, when the two plastic members 129 are placed one on the other at the connection between them, the hooks 128 of them may be engaged individually with the hubs 44 of the associated bearing blocks 43 at the same height or vertical position with regard to the two circulatory frames 11 interconnected by the upper link 127. Also the roller 117 of the upper guide roller 115 which interconnects the two plastic members 129 is positioned in the guide channel 17 of the upper endless rail 12.

Figure 25:
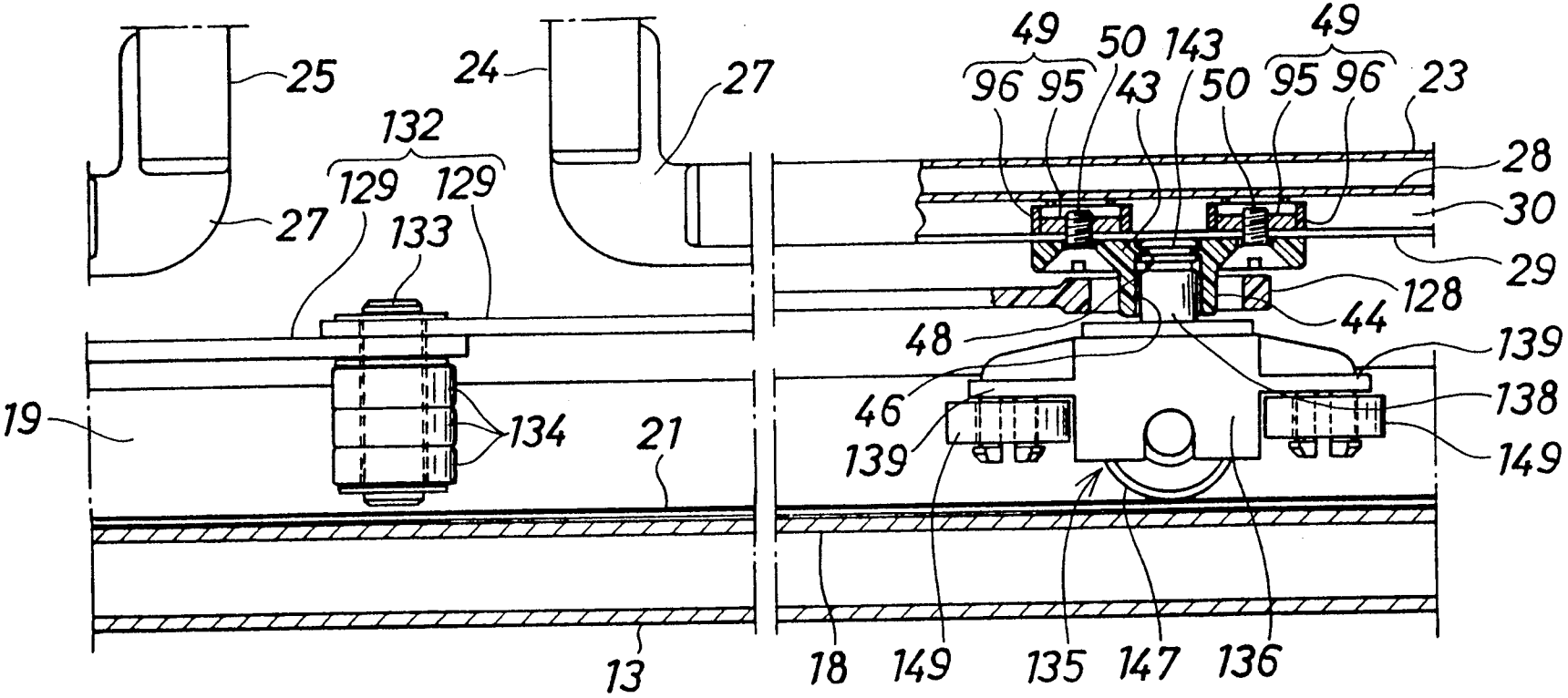
FIG. 25 is a front elevational view, partly in section, showing a modified lower link for interconnecting circulatory frames at the lower side portions thereof together with a modified caster.
Figure 26:
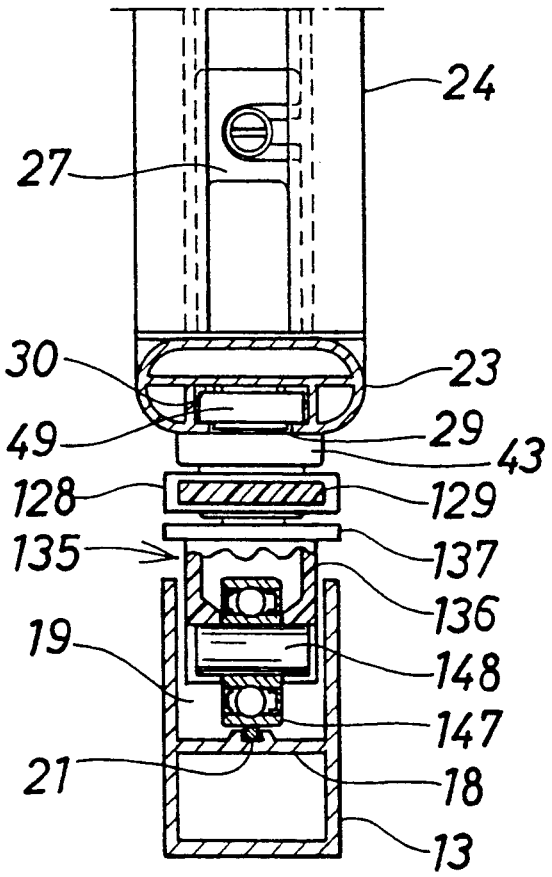
FIG. 26 is a side elevational vertical sectional view showing the lower link and the caster of FIG. 25 taken along a mid portion as viewed in the leftward direction.
Figure 27:
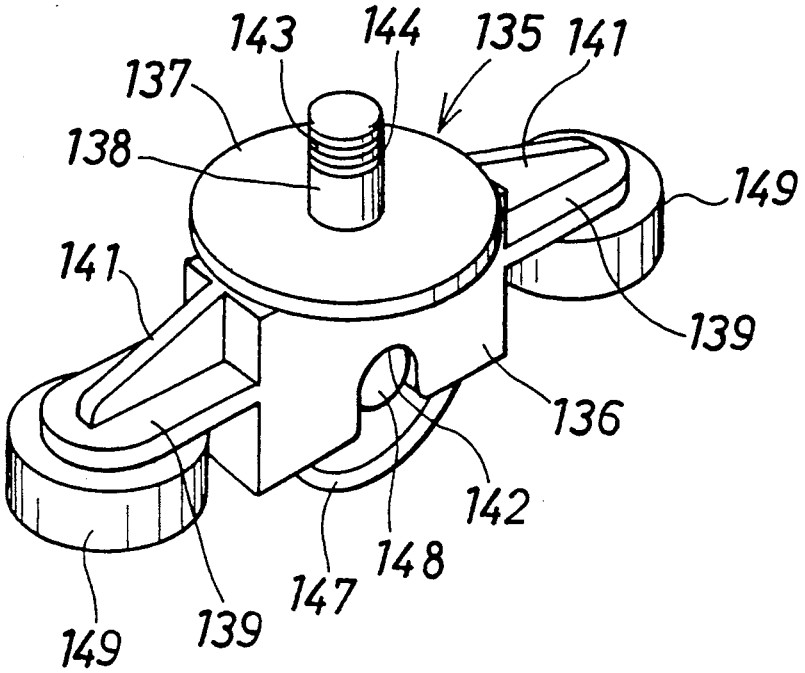
FIG. 27 is a perspective view of the caster shown in FIG. 25.
Figure 28:
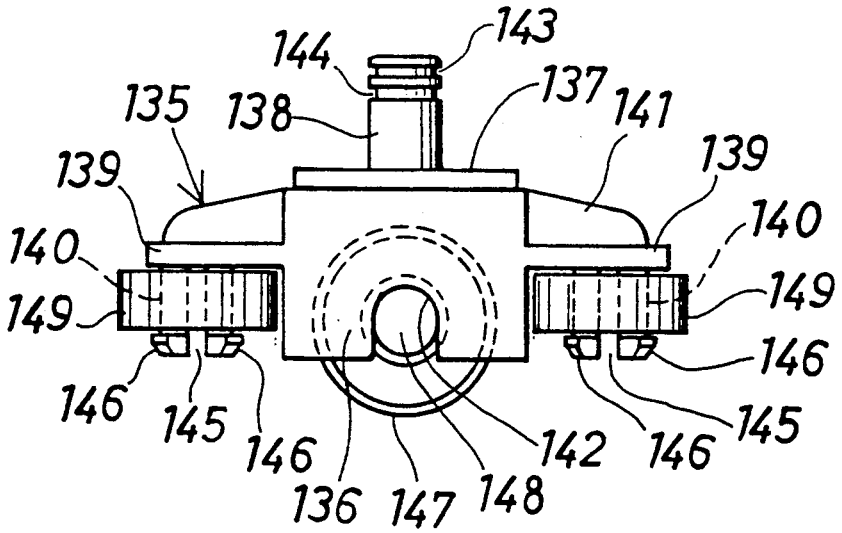
FIG. 28 is a front elevational view of the caster shown in FIG. 25.
Figure 29:
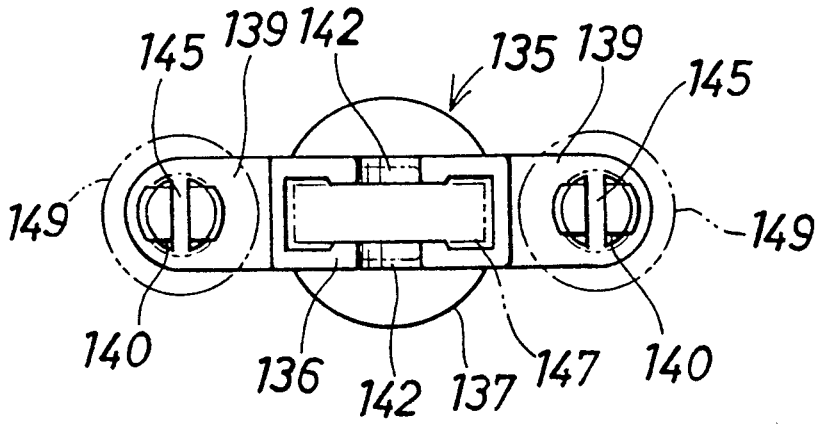
FIG. 29 is a bottom plan view, partly omitted, of the caster shown in FIG. 25.

FIGS. 25 and 26 show a modified lower link for interconnecting circulatory frames at the lower side portions thereof together with a modified caster, and FIGS. 27 to 29 only show the modified caster. Referring first to FIGS. 25 and 26, the lower link 132 includes a pair of plastic members 129 similar to the plastic members 129 of the upper link 127 described above and connected to each other by a roller shaft 133. Three rollers 134 made of a plastic material are supported in a vertical column for individual rotation on the roller shaft 133 and positioned in the guide channel 19 of the lower endless rail 13.

Referring now to FIGS. 25 to 29, the modified caster 135 is formed as a unitary molded member from a plastic material and has a box-shaped frame 136, a flange portion 137, a pivot 138, a pair of left and right wing portions 139, a pair of left and right shaft portions 140, and a pair of left and right reinforcing ribs 141. A bearing recess 142 is formed in each of the opposite walls of the frame 136, and a pair of annular grooves 143 and 144 are formed on an outer periphery of the pivot 138 while a slit 145 and an annular projection 146 are formed on each of the shaft portions 140. A support roller 147 made of a metal is supported for rotation on the frame 136 with an axle 148 thereof received in the bearing recesses 142 of the frame 136, and a lower guide roller 149 made of a plastic material is supported for rotation on each of the shaft portions 140. The pivot 138 of the caster 135 is inserted in the bearing hole 46 of the bearing block 43 until the annular groove 143 thereon is fitted with the annular projection 48 of the bearing hole 46 as shown in FIG. 25 so that the caster 135 is mounted for turning motion around a vertical axis on the bearing block 43 without being let off from the bearing hole 46.

When two adjacent frames 11 are interconnected by the upper link 127 shown in FIGS. 22 and 24 and the lower link 132 shown in FIGS. 25 and 26, the two plastic members 129 of each of the upper and lower links 127 and 132 can be pivoted relative to each other at the connection between them. Consequently, when one of the circulatory frames 11 is diverted at a location at which the upper and lower endless rails 12 and 13 are curved, it is acted upon only by a reduced restraining force from any other circulatory frame 11, which assures a smooth diverting movement of the circulatory frame 11. Particularly with regard to the lower link 132, since the three rollers 134 are supported in vertical column for individual rotation on the roller shaft 133 by which the two plastic members 129 are connected to each other, the frictional force when the rollers 134 are rolled on the inner face of the guide channel 19 is originally low, and in addition, even if one of the rollers 134 is broken, the function of the rollers 134 can be maintained by the remaining rollers 134. Further, when a circulatory frame 11 is diverted, if the roller shaft 133 is inclined by a force acting upon the plastic members 129 of the link 132, then the roller 134 at the top among the rollers 134 is pressed against one of a pair of inner faces of the guide channel 19 while the roller 134 at the bottom is pressed against the other inner face of the guide channel 19, but since the two rollers 134 can rotate individually and the remaining roller 134 is interposed intermediately between the two rollers 134, the restraining force when the rollers 134 are inclined and pressed strongly against the inner faces of the guide channel 19 is so low that the diverting movement of the circulatory frame 11 can take place smoothly.

Figure 30:
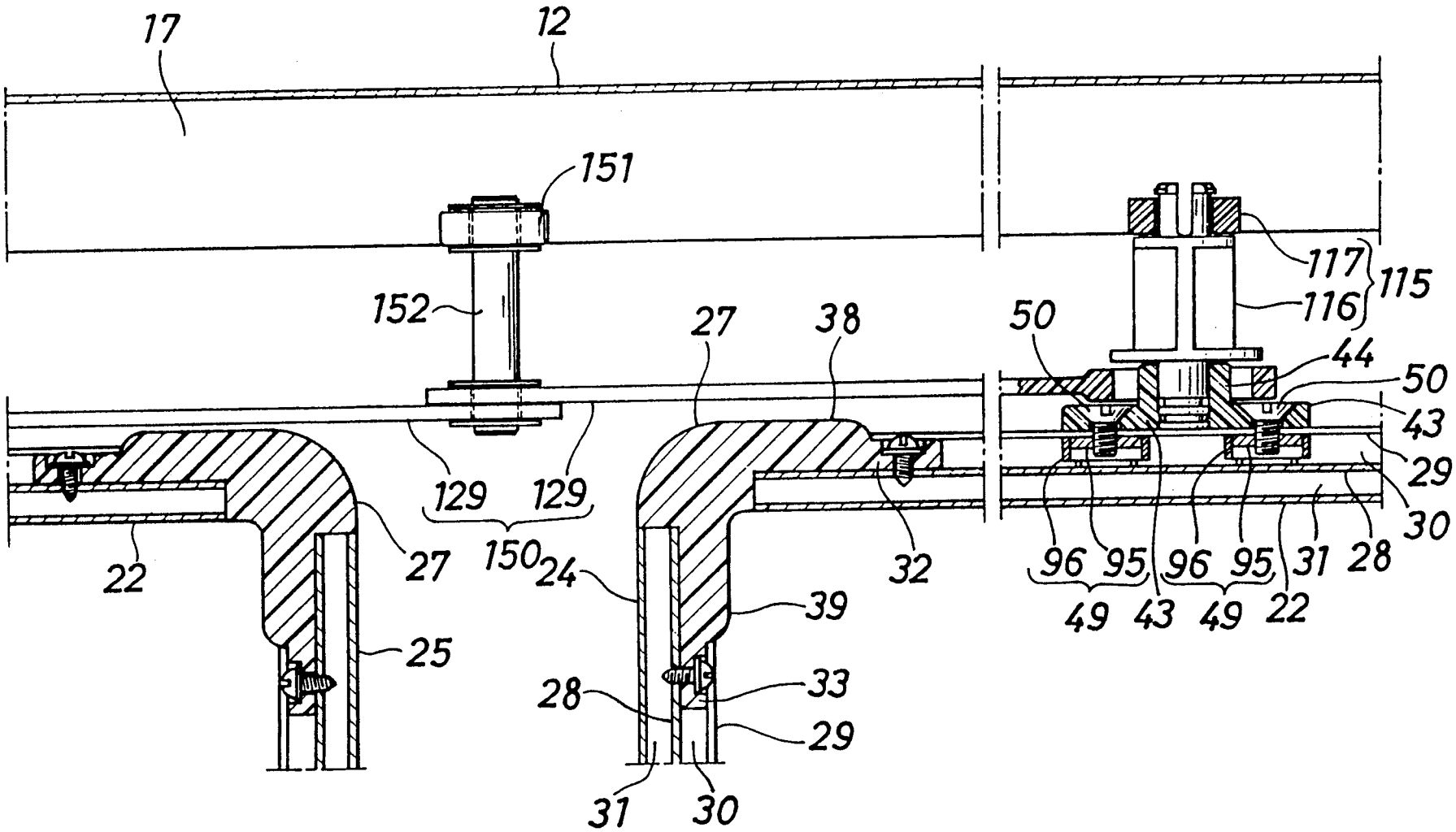
FIG. 30 is a front elevational view, partly in section, showing another upper link for interconnecting circulatory frames at the top side portions thereof.

FIG. 30 shows another modified upper link. Referring to FIG. 30, the modified upper link 150 includes a pair of plastic members 129 interconnected by a roller shaft 152 which has a plastic roller 151 supported for rotation at an upper end thereof.

Figure 31:
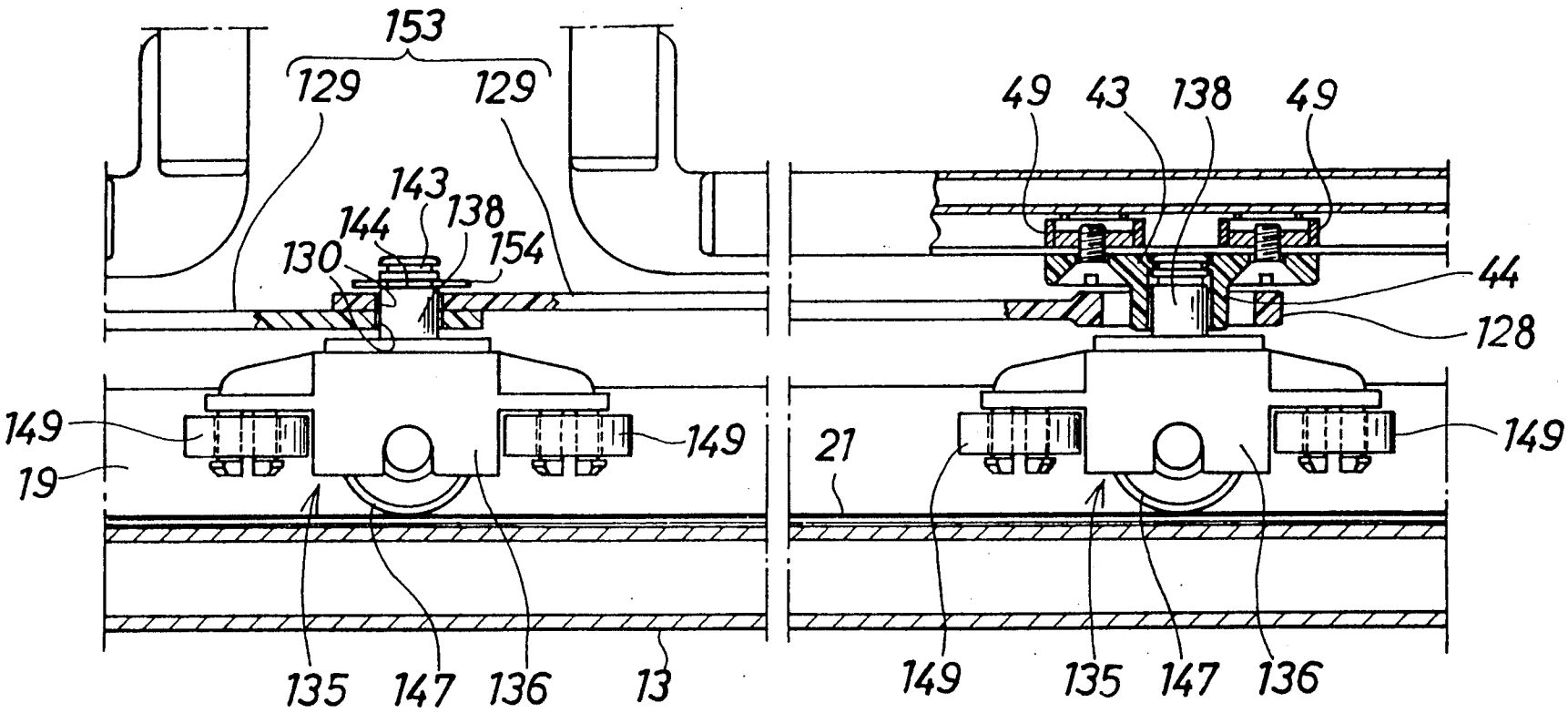
FIG. 31 is a similar view but showing a further upper link for interconnecting circulatory frames at the top side portions thereof.

FIG. 31 shows another modified lower link. Referring to FIG. 31, the modified lower link 153 employs the caster 135 described hereinabove for interconnection of a pair of plastic members 129. In this instance, the pivot 138 of the caster 135 is fitted in the mutually aligned holes 130 of the two plastic members 129, and an E-snap ring 154 is snapped in the annular groove 144 of the pivot 138.

Figure 32:
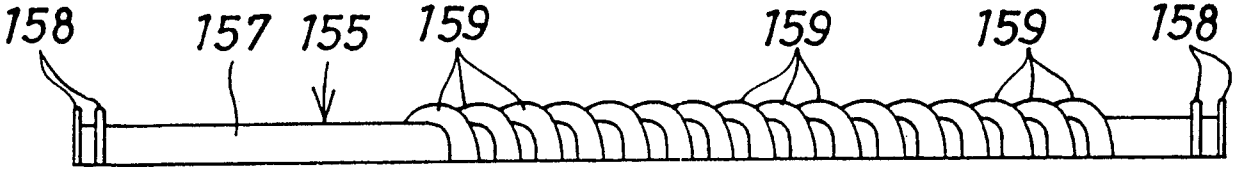
FIG. 32 is a front elevational view showing a modified hanger bar.
Figure 33:
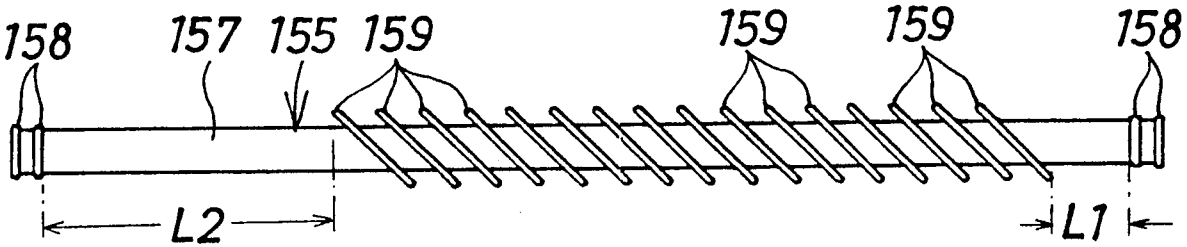
FIG. 33 is a plan view of the hanger bar shown in FIG. 32.
Figure 34:
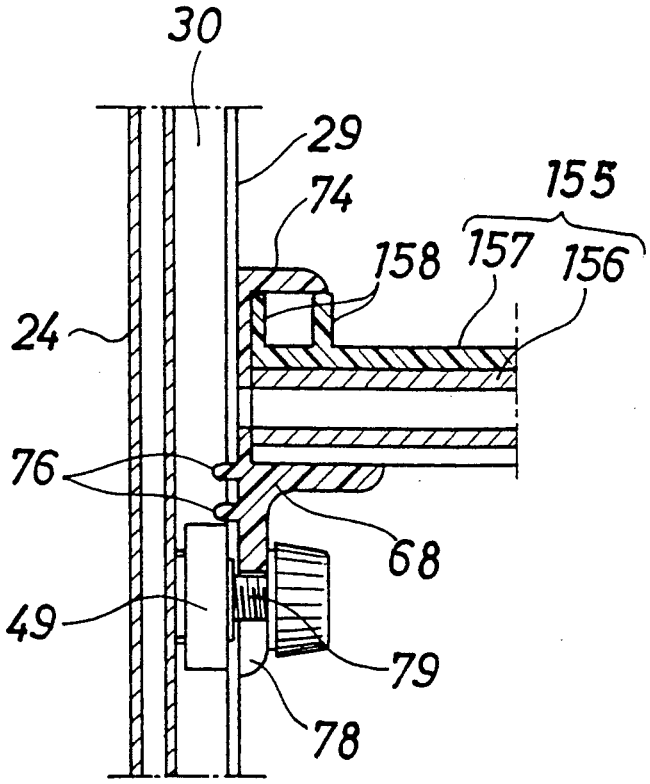
FIG. 34 is an enlarged sectional view showing a mounting structure for the hanger bar shown in FIG. 32.

FIGS. 32 to 34 show a modified hanger bar adapted to be mounted between the left and right side portions 24 and 25 of a circulatory frame 11. Referring to FIGS. 32 to 34, the hanger bar 155 includes a core pipe 156 made of aluminum and a plastic cover 157 having a U-shaped cross section and fitted on an outer periphery of the core pipe 156 with an opening thereof directed downwardly. A pair of flange portions 158 are formed integrally at each of the opposite ends of an outer periphery of the cover 157. A large number of fins 159 are formed integrally at fixed intervals at a portion of the outer periphery of the cover 157 except an end portion of the length L1 and the other end portion of the length L2 which is greater than L1 such that they extend obliquely to an axial line of the cover 157. The hanger bar 155 is mounted horizontally between the left and right side portions 24 and 25 of the circulatory frame 11 with the flange portions 158 thereof fitted with the mouth portions 74 of the sockets 68 securely mounted on the left and right side portions 24 and 25.

When a large number of clothes are to be hung on the thus mounted hanger bar 155, the hooks of clothes hangers are hung on the hanger bar 155 individually between adjacent ones of the fins 159. Since the fins 159 extend obliquely with respect to the axial line of the hanger bar 155, the large number of clothes hung by means of the clothes hangers on the hanger bar 155 are arranged at the fixed intervals obliquely with respect to the hanger bar 155. Where the clothes are hung in this manner, the distance between opposing clothes on opposing circulatory frames 11 at the front and rear straight portions of the upper and lower endless rails 12 and 13 is greater than that when the clothes are otherwise hung perpendicularly to the axial line of the hanger bar 155, and consequently, the possibility that such opposing clothes may interfere with each other is reduced. Further, since the fins 159 are not provided within the range of the length L1 at one end portion of the cover 157 and within the range of the length L2 at the other end portion of the cover 157, which is longer than the length L1, if no clothes are hung within the ranges of the cover 157 of the hanger bar 155, then particularly when a circulatory frame 11 is diverted at the curved portions of the upper and lower endless rails 12 and 13, the possibility that the clothes on the circulatory frame 11 and an adjacent circulatory frame 11 interfere with each other is reduced because the distance between the clothes on the two circulatory frames 11 is great.

Figure 35:
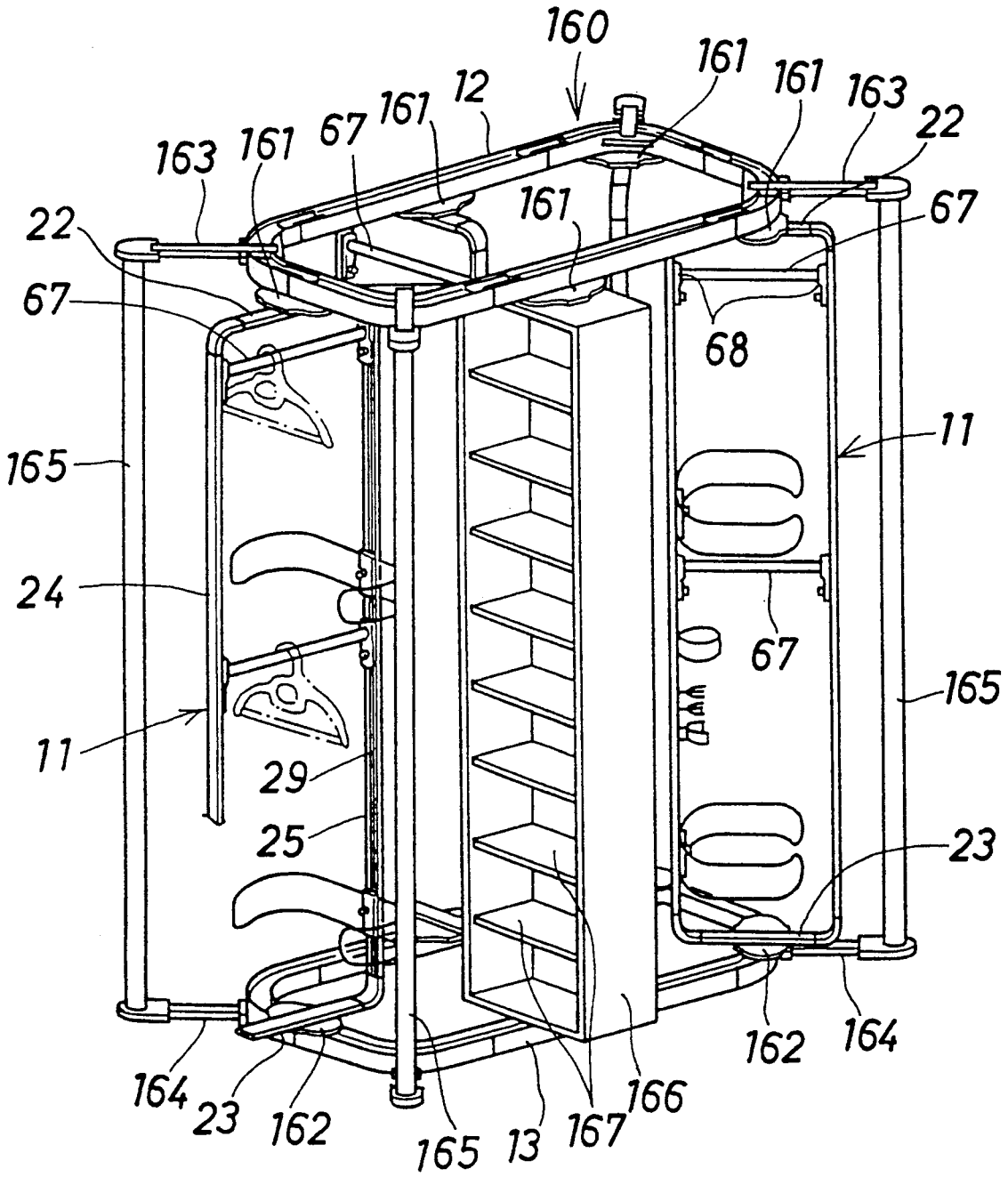
FIG. 35 is a perspective view showing another entire circulatory storage apparatus to which the present invention is applied.

Referring now to FIG. 35, there is shown another circulator storage apparatus to which the present invention is applied. The circulatory storage apparatus shown is a modification to the circulator storage apparatus described hereinabove and employs a circulatory frame 11 similar to the circulatory frame 11 described hereinabove. However, an upper plate 161 is securely mounted at the center of the upper side portion 22 of the circulatory frame 11, and a similar lower plate 162 is securely mounted at the center of the lower side portion 23 of the circulatory frame 11. Though not shown, a pair of such upper guide rollers 41 or 115 as shown in FIGS. 7 or 22 are mounted on the upper plate 161, and a pair of such casters 42 or 135 as shown in FIGS. 8 or 25 are mounted on the lower plate 162. The circulatory frames 11 are mounted between the upper and lower endless rails 12 and 13 by way of the upper and lower plates 161 and 162 in such orientation that they extend perpendicularly to the upper and lower endless rails 12 and 13. Where the circulatory frames 11 are directed in this manner, one half of each of them is positioned within the elliptic zone of the upper and lower endless rails 12 and 13, and accordingly, the endless rails 12 and 13 cannot be interconnected by means of the stays 16 in the elliptic zone as in the circulatory storage apparatus shown in FIG. 1. Therefore, in the circulatory storage apparatus of FIG. 35, a pair of upper and lower outriggers 163 and 164 are provided at each of four corners of the endless rails 12 and 13 and have outer ends thereof interconnected by means of a vertical stay 165.

It is to be noted that reference numeral 166 in FIG. 35 denotes an accommodating box having a plurality of shelf plates 167 therein. The accommodating box 166 is mounted between the upper and lower endless rails 12 and 13 by way of a pair of upper and lower plates 161 and 162 similarly to the circulatory frames 11 so that it can be circulated along the upper and lower endless rails 12 and 13 together with the circulating frames 11.

What is claimed is:

1. A circulatory storage apparatus, comprising:

a pair of upper and lower endless rails, said upper endless rail having a downwardly opened guide channel formed along the overall length therein while said lower endless rail has an upwardly opened guide channel formed along the overall length therein;

a plurality of rectangular circulatory frames mounted for circulatory movement along said upper and lower endless rails and each having a pair of parallel upper and lower side portions and a pair of parallel left and right side portions;

a plurality of casters mounted on said lower side portion of each of said circulatory frames and positioned in said guide channel of said lower endless rail, each of said casters including a support roller for rolling on an inner bottom face of said guide channel of said lower endless rail and a lower guide roller or rollers for contacting with and rolling on an inner side face or faces of said guide channel of said lower endless rail;

a plurality of upper guide rollers mounted on said upper side portion of each of said circulatory frames for contacting with and rolling on an inner side face or faces of said guide channel of said upper endless rail; and a pair of upper and lower series of links for interconnecting said circulatory frames.

2. A circulatory storage apparatus as claimed in claim 1, wherein each of said casters includes a caster frame which has a pivot provided at the center of an upper face thereof and has a pair of wing portions on the opposite sides thereof, and an axle for said support roller is supported horizontally on said caster frame while a shaft is provided at each of said wing portions and has one of the lower guide rollers supported for rotation thereon.

3. A circulatory storage apparatus as claimed in claim 2, wherein each of said casters is formed as a unitary molded member of a plastic material and including said caster frame, said pivot, said wing portions and the shafts.

4. A circulatory storage apparatus as claimed in claim 2, wherein each of said circulatory frames is constructed such that said upper side portion thereof has a C-shaped cross section defining a groove with an upwardly opened slit while said lower side portion thereof has a C-shaped cross section defining a groove with a downwardly opened slit and a plurality of bearing blocks each having a bearing hole and a mounting hole formed therein are secured to said upper and lower side portions such that a screw fitted in said mounting hole of each of said bearing blocks is screwed through the slit of said upper or lower side portion of the circulatory frame into a nut which is inserted in said groove of said upper or lower side portion, each of said casters being mounted for turning motion around a vertical axis on the lower side of said lower side portion of the circulatory frame with said pivot thereof fitted in said bearing hole of one of said bearing blocks secured to said lower side portion of the circulatory frame, each of said upper guide rollers being mounted for rotation on the upper side of said upper side portion of the circulatory frame with said shaft thereof fitted in said bearing hole of one of said bearing blocks secured to said upper side portion of the circulatory frame.

5. A circulatory storage apparatus as claimed in claim 1, further comprising a hard wire having a circular shape on at least an upper face thereof and provided on the inner bottom face of said guide channel of said lower endless rail over the overall length thereof in such a manner as to extend upwardly from the inner bottom face and contact said lower guide roller or rollers.

6. A circulatory storage apparatus as claimed in claim 1, wherein each said of said links includes a plurality of members connected for pivotal motion to each other, and further comprising a roller supported for rotation at each of connecting portions of said members of each of said links to interconnect the two adjacent members of the link and positioned to contact with and roll on the inner side face or faces of said guide channel of said upper or lower endless rail.

7. A circulatory storage apparatus as claimed in claim 1, wherein each of said circulatory frames is constructed such that said left and right side portions thereof individually have C-shaped cross sections individually defining grooves with inwardly opened slits and a hanger bar is mounted between said left and right side portions of the circulatory frame with the opposite ends thereof fitted in a pair of left and right sockets which are secured to said left and right side portions, respectively, by means of screws threaded through said sockets into nuts individually inserted in said grooves of said left and right side portions.

8. A circulatory storage apparatus as claimed in claim 7, wherein said hanger bar has a plurality of fins formed at fixed intervals at a portion thereof other than an end portion of a first length and the other end portion of a second length greater than the first length in such a manner as to extend obliquely to an axial line of said hanger bar.

9. A circulatory storage apparatus as claimed in claim 1, wherein said upper, lower and left, right side portions of each of said circulatory frames are individually formed from separate metal members having identical C-shaped cross sections defining a groove, and the four metal members are joined together into the form of a rectangular frame by means of four elbows.

10. A circulatory storage apparatus as claimed in claim 9, wherein each of said elbows is fitted at a pair of opposite end portions thereof in the grooves of two associated ones of said metal members and is secured to the two associated metal members by means of fastening screws.

11. A circulatory storage apparatus as claimed in claim 1, further comprising a hanger bar mounted between said left and rightward side portions of at least one of said circulatory frames by means of a pair of left and right brackets in such a manner as to be positioned outwardly with respect to said left and right side portions.

12. A circulatory storage apparatus as claimed in claim 1, wherein each of said circulatory frames is constructed such that said upper, lower and left, right side portions thereof individually have identical C-shaped cross sections individually defining nut receiving grooves with inwardly opened slits and a nut having a flexible projection on a rear face thereof is inserted for sliding movement in each of said nut receiving grooves with said flexible projection pressed against an inner face of the nut receiving groove so as to allow a desirable part to be mounted on the upper, lower, left or right side portion of the circulatory frame by screwing a screw into said nut through the part.

* * * * *